US007471271B2

(12) United States Patent
Osame et al.

(10) Patent No.: US 7,471,271 B2
(45) Date of Patent: Dec. 30, 2008

(54) DISPLAY DEVICE AND DRIVING METHOD OF THE SAME

(75) Inventors: Mitsuaki Osame, Atsugi (JP); Aya Anzai, Tsukui (JP); Yu Yamazaki, Setagaya (JP); Ryota Fukumoto, Atsugi (JP)

(73) Assignee: Semiconductor Energy Laboratory Co., Ltd., Kanagawa-ken (JP)

( * ) Notice: Subject to any disclaimer, the term of this patent is extended or adjusted under 35 U.S.C. 154(b) by 536 days.

(21) Appl. No.: 10/860,681

(22) Filed: Jun. 4, 2004

(65) Prior Publication Data

US 2005/0001830 A1 Jan. 6, 2005

(30) Foreign Application Priority Data

Jun. 18, 2003 (JP) ..... 2003-174147
Jul. 23, 2003 (JP) ..... 2003-278484

(51) Int. Cl.
*G09G 3/30* (2006.01)
*G09G 3/32* (2006.01)
*G09G 3/10* (2006.01)

(52) U.S. Cl. ..... 345/82; 345/76; 315/169.3

(58) Field of Classification Search ..... 345/82, 345/76, 204, 87, 98–100; 315/169.1–169.4
See application file for complete search history.

(56) References Cited

U.S. PATENT DOCUMENTS 4,523,189 A 6/1985 Takahara et al.
4,806,496 A 2/1989 Suzuki et al.
4,945,352 A * 7/1990 Ejiri ..... 345/91
4,951,041 A 8/1990 Inada et al.
5,414,443 A 5/1995 Kanatani et al.
5,552,678 A 9/1996 Tang et al.
5,641,991 A 6/1997 Sakoh
5,847,516 A 12/1998 Kishita et al.

(Continued)

FOREIGN PATENT DOCUMENTS

EP 1 094 436 4/2001

(Continued)

OTHER PUBLICATIONS

Specification, Claims, Abstract of U.S. Appl. No. 11/013,932, filed Dec. 17, 2004, Osame et al.

(Continued)

*Primary Examiner*—Amr Awad
*Assistant Examiner*—Stephen G Sherman
(74) *Attorney, Agent, or Firm*—Eric J. Robinson; Robinson Intellectual Property Law Office, P.C.

(57) ABSTRACT

The present invention provides a circuit configuration for applying a reverse voltage (or a reverse bias) for enhancing the reliability by controlling the degradation of the light emitting element in a display device having a pixel circuit, and a method thereof. A reverse voltage is applied to a pixel circuit having at least a switching transistor connected to a signal line, a driving transistor connected to a light emitting element, and a current controlling transistor connected to the driving transistor in series. A reverse voltage applying circuit includes an analog switch or a clocked inverter, and a reverse voltage applying transistor which is turned ON when a reverse voltage is applied.

16 Claims, 15 Drawing Sheets

U.S. PATENT DOCUMENTS

| | | | | |
|---|---|---|---|---|
| 5,880,621 | A * | 3/1999 | Ohashi | 327/534 |
| 5,882,761 | A | 3/1999 | Kawami et al. | |
| 5,955,765 | A | 9/1999 | Yamazaki et al. | |
| 5,990,629 | A | 11/1999 | Yamada et al. | |
| 6,064,158 | A | 5/2000 | Kishita et al. | |
| 6,087,245 | A | 7/2000 | Yamazaki et al. | |
| 6,121,943 | A | 9/2000 | Nishioka et al. | |
| 6,151,006 | A | 11/2000 | Yanagi et al. | |
| 6,380,689 | B1 | 4/2002 | Okuda | |
| 6,452,341 | B1 | 9/2002 | Yamauchi et al. | |
| 6,522,319 | B1 | 2/2003 | Yamazaki | |
| 6,529,178 | B1 | 3/2003 | Kimura | |
| 6,661,180 | B2 | 12/2003 | Koyama | |
| 6,730,966 | B2 | 5/2004 | Koyama | |
| 6,750,833 | B2 | 6/2004 | Kasai | |
| 6,809,482 | B2 | 10/2004 | Koyama | |
| 6,872,973 | B1 | 3/2005 | Koyama et al. | |
| 6,873,116 | B2 | 3/2005 | Kimura et al. | |
| 6,909,111 | B2 | 6/2005 | Yamagata et al. | |
| 7,012,587 | B2 * | 3/2006 | Satoh et al. | 345/82 |
| 7,122,969 | B2 | 10/2006 | Fukumoto et al. | |
| 7,141,934 | B2 | 11/2006 | Osame et al. | |
| 7,173,586 | B2 | 2/2007 | Osame et al. | |
| 2001/0054991 | A1 | 12/2001 | Kimura et al. | |
| 2002/0042152 | A1 | 4/2002 | Yamazaki et al. | |
| 2002/0047839 | A1 | 4/2002 | Kasai | |
| 2002/0113760 | A1 | 8/2002 | Kimura | |
| 2002/0180671 | A1 | 12/2002 | Inukai | |
| 2003/0058210 | A1 | 3/2003 | Yamazaki et al. | |
| 2003/0160745 | A1 | 8/2003 | Osame et al. | |
| 2003/0201962 | A1 * | 10/2003 | Monomohshi | 345/89 |
| 2004/0251953 | A1 | 12/2004 | Yamazaki et al. | |
| 2004/0252565 | A1 | 12/2004 | Yamazaki et al. | |
| 2005/0012686 | A1 | 1/2005 | Osame et al. | |
| 2005/0017928 | A1 * | 1/2005 | Osame et al. | 345/76 |
| 2005/0134189 | A1 | 6/2005 | Osame et al. | |
| 2005/0162354 | A1 | 7/2005 | Osame et al. | |

FOREIGN PATENT DOCUMENTS

| | | |
|---|---|---|
| EP | 1 094 438 | 4/2001 |
| EP | 1 103 946 | 5/2001 |
| JP | 64-031197 | 2/1989 |
| JP | 10-041068 | 2/1998 |
| JP | 10-312173 | 11/1998 |
| JP | 2001-117534 | 4/2001 |
| JP | 2001-343933 | 12/2001 |

OTHER PUBLICATIONS

S.A. Van Slyke et al., *Organic Electroluminescent Devices with Improved Stability*, Appl. Phys. Lett., vol. 69, No. 15, Oct. 7, 1996, pp. 2160-2162.

D. Zou et al., *Spontaneous and Reverse-Bias Induced Recovery Behavior in Organic Electroluminescent Diodes*, Appl. Phys. Lett., vol. 72, No. 19, May 11, 1998, pp. 2484-2486.

D. Zou et al., *Improvement of Current-Voltage Characteristics in Organic Light Emitting Diodes by Application of Reversed-Bias Voltage*, Jpn. J. Appl. Phys., vol. 37, Part 2, No. 11B, Nov. 15, 1998, pp. L1406-L1408.

* cited by examiner

DISPLAY DEVICE AND DRIVING METHOD OF THE SAME

BACKGROUND OF THE INVENTION

1. Field of the Invention

The present invention relates to a display device having a light emitting element, and a driving method of the same.

2. Description of the Related Art

In recent years, research and development have been advanced on a display device having a light emitting element (self-luminous element). Such a display device is widely used as a display of a portable phone and a monitor of a personal computer by taking advantages of high image quality, thinness, and lightweight. In particular, such a display device has features such as high response, low voltage, and low power consumption that are suitable for displaying a moving image. Therefore, it is expected to be applied to a wide range of devices including a new generation of portable phone and a portable information terminal (PDA).

Luminance of the light emitting element degrades gradually over time. For example, a predetermined luminance which is obtained with a certain voltage $V_o$ and a certain current $I_o$ cannot be obtained with the same voltage $V_o$ any more because only the current $I_o'$ is supplied to the light emitting element due to the degradation over time. Further, the same luminance cannot be always obtained with a certain current due to the degradation over time of the light emitting element.

This is because the light emitting element generates heat by receiving voltage or current, which changes the qualities of surface of the film over the light emitting element and surface of the electrode. Further, as the light emitting elements variously changes the conditions in each pixel, an image persistence may appear.

In order to enhance the reliability by suppressing the degradation of the light emitting element, which is one of the changed conditions, it is suggested that a reverse voltage which is in the opposite direction to the voltage applied to the light emitting element when it emits light is applied to the light emitting element (refer to Patent Document 1).

[Patent Document 1]

Japanese Patent Application Laid-Open No. 2001-117534

SUMMARY OF THE INVENTION

These and other objects, features and advantages of the present invention will become more apparent upon reading of the following detailed description along with the accompanied drawings.

A pixel circuit having a light emitting element can form a variety of configurations. The invention provides a circuit configuration for applying a reverse voltage for enhancing the reliability by controlling the degradation of the light emitting element in a display device having a pixel circuit which is different from the one disclosed in Patent Document 1, and a method thereof.

In view of the aforementioned, the invention provides a circuit for applying a reverse voltage to the light emitting element in a pixel circuit which includes at least a switching transistor connected to a signal line (hereinafter referred to as a switching transistor), a driving transistor connected to the light emitting element (hereinafter referred to as a driving transistor), and a current controlling transistor connected to the driving transistor in series (hereinafter referred to as a current controlling transistor).

According to the circuit configuration of the invention, it is preferable that a voltage Vgs between the gate and source of a driving transistor does not change over time due to a parasitic capacitance and a wiring capacitance by fixing the gate potential of the driving transistor. As a result, display unevenness caused by the variation in voltage Vgs between the gate and source of the driving transistor can be suppressed.

According to the invention, the current controlling transistor connected to the signal line is turned OFF. For example, the invention provides a circuit for applying a reverse voltage to a light emitting element in a pixel circuit having an erasing transistor for releasing a charge accumulated in a capacitor connected to a current controlling transistor (hereinafter referred to as an erasing transistor) additionally.

The driving transistor can operate in a saturation region and a linear region. The switching transistor, the current controlling transistor, and the erasing transistor can operate in a linear region. When operating in a linear region, the aforementioned transistors require only low driving voltage, therefore, low power consumption of a display device can be realized.

A reverse voltage (also referred to as a reverse bias) is applied so that the potential relation of the anode and cathode of the light emitting element become opposite. That is to say, a voltage which reverses the potential of an anode line communicating the anode and the potential of a cathode line communicating the cathode is applied. It should be noted that the anode line and the cathode line are connected to a power supply line. The voltage to reverse the potentials may be applied from the power supply line.

The circuit for applying a reverse voltage (hereinafter referred to as a reverse voltage applying circuit) includes a semiconductor circuit such as an analog switch and a clocked inverter, and a transistor which is turned ON when the reverse voltage is applied (also referred to as a reverse voltage applying transistor).

The analog switch includes a first transistor and a second transistor which at least have different conductivities. The clocked inverter includes a first transistor, a second transistor, and a third transistor which at least have different conductivities. A fourth transistor which has a different conductivity from that of the third transistor may be provided as well.

A transistor may be a thin film transistor (TFT) formed by using non-crystalline semiconductor film represented by amorphous silicon and polycrystalline silicon. Also, an MOS transistor formed by using a semiconductor substrate or an SOI substrate, a junction transistor, a transistor formed by using an organic semiconductor or a carbon nanotube, and other transistors may be used.

The invention provides a circuit configuration for applying a reverse voltage for enhancing the reliability by controlling the degradation of the light emitting element in a display device having a novel pixel circuit, and a method thereof.

DETAILED DESCRIPTION OF THE INVENTION

Figure 1A:
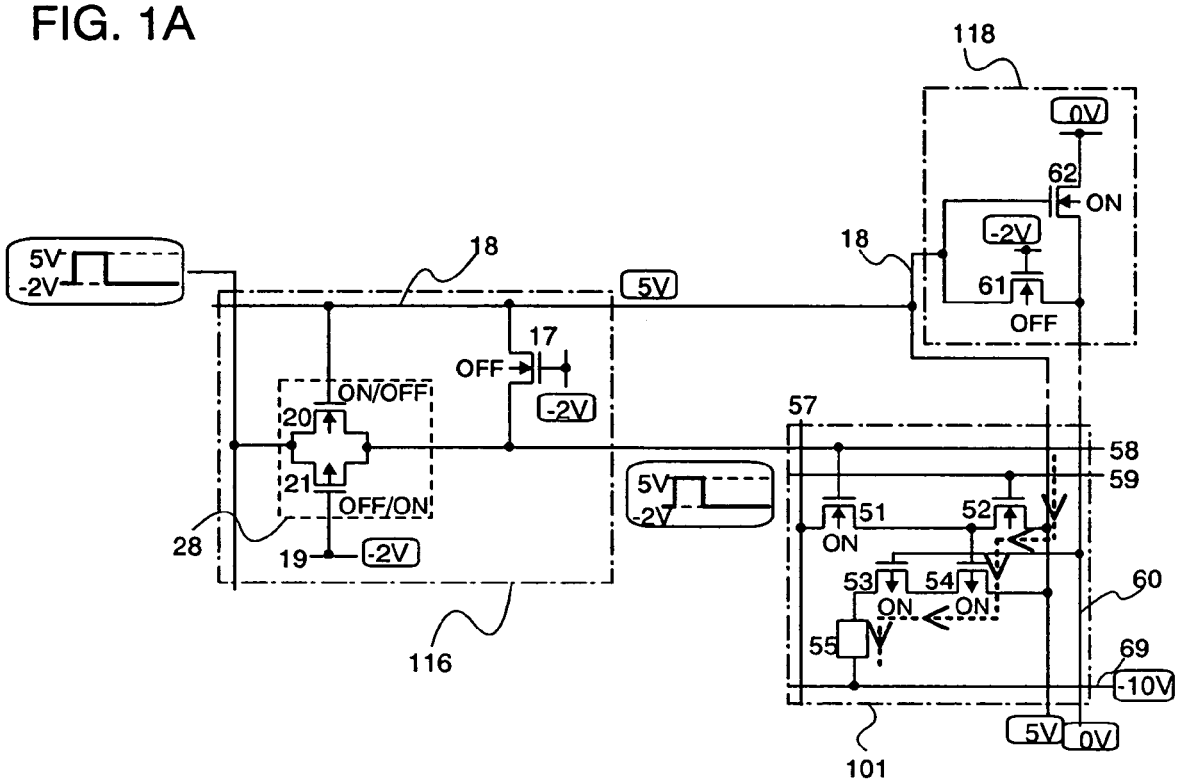
FIGS. 1A and 1B are diagrams describing the display device of the invention and the driving method thereof.

Hereinafter described are embodiment modes of the invention with reference to the accompanying drawings. It is possible for the present invention to be implemented in many other modes, and it is possible for a person having ordinary skill in the art to understand that the modes or details of the present invention may be varied without deviating from the aspect or purpose of the present invention. Therefore, the present invention is not limited to the description of the embodiment modes. Note that portions having the same position or the same function are designated as the same reference numerals in all drawings, and repeated explanations are omitted.

In the embodiment modes hereinafter described, a transistor has three terminals: namely, gate, source, and drain, however, the source electrode and the drain electrode cannot be distinguished because of the structure of transistor. Therefore, one of the source electrode and the drain electrode is referred to as a first electrode and the other is referred to as a second electrode when describing the connection between elements.

EMBODIMENT MODE 1

In this embodiment mode, a specific example is described that a reverse voltage applying circuit having an analog switch is used in a pixel circuit having at least a switching transistor, an erasing transistor, a driving transistor, and a current controlling transistor.

FIG. 1A shows a state in which a forward voltage (a voltage in the direction that makes a light emitting element emit light) is applied and the light emitting element emits light. A reverse voltage applying circuit 116 shown in FIG. 1A includes an analog switch 28 having an n-channel transistor 20 and a p-channel transistor 21. The gate electrode of the n-channel transistor 20 is connected to an anode line 18 of which potential is maintained at 5 V in this embodiment mode. The gate electrode of the p-channel transistor 21 is connected to a power supply line of which potential is maintained constant, or to a cathode line. In this embodiment mode, it is connected to a first power supply line 19 of which potential is maintained at −2 V. An output wiring (output terminal) of the analog switch 28 is connected to a first electrode of a reverse voltage applying transistor 17 and a scan line 58 or a reset line 59 connected to the gate electrode of the erasing transistor. The output wiring of the analog switch 28 is connected to the first electrode of the reverse voltage applying transistor 17 and the scan line 58 in this embodiment mode.

The gate electrode of the reverse voltage applying transistor 17 is connected to the power supply line of which potential is maintained constant, or to the cathode line. The first electrode of the reverse voltage applying transistor 17 is connected to the anode line and the second electrode thereof is connected to the output wiring of the analog switch 28. In this embodiment mode, the potential of the gate electrode of the reverse voltage applying transistor 17 is maintained at −2 V. Further, the first electrode of the reverse voltage applying transistor 17 is connected to the scan line 58 connected to the gate electrode of the switching transistor 51. The first electrode of the reverse voltage applying transistor may be connected to the reset line 59 connected to the gate electrode of the erasing transistor.

Provided that pulse signals of −2 and 5V is outputted from a buffer circuit in a scan driver circuit to the analog switch 28 in the aforementioned circuit configuration, either the n-channel transistor 20 or the p-channel transistor 21 is turned ON and the reverse voltage applying transistor 17 is turned OFF. Specifically, the p-channel transistor 21 is turned ON when a Low signal is inputted, while the n-channel transistor 20 is turned ON when a High signal is inputted. The signal outputted from the buffer circuit is inputted to the scan line 58.

When such a signal is inputted to the analog switch 28, a switching transistor 51 is turned ON and a video signal is inputted from a signal line 57 in a pixel 101. The switching transistor 51 is an n-channel transistor and a video signal is inputted as a voltage in this embodiment mode. The switching transistor 51 may be a p-channel transistor as well.

Then, a driving transistor 53 and a current controlling transistor 54 are turned ON, and a light emitting element 55 emits light. The cathode of the light emitting element 55 is connected to a cathode line 69 of which potential is maintained at −10 V, while the anode thereof is connected to an anode line 18 of which potential is maintained at 5 V.

The driving transistor 53 and the current controlling transistor 54 are p-channel transistors in this embodiment mode, however, they may be n-channel transistors as well. It is preferable that the driving transistor 53 and the current controlling transistor 54 have the same conductivities.

At this time, an erasing period for selecting the reset line 59 is provided as required by operating an erasing transistor 52. The erasing transistor 52 is an n-channel transistor in this embodiment mode, however, it may be a p-channel transistor as well. For the erasing transistor and the operation thereof, refer to Japanese Patent Application Laid-open No. 2001-343933, with which the invention can be used in combination.

The anode line 18 connected to the first electrodes of the erasing transistor 52 and the first electrode of the current controlling transistor 54, and a second power supply line 60 connected to the gate electrode of the driving transistor 53 are connected to a controlling circuit 118. Note that a voltage Vgs between the gate and source of the driving transistor 53 does not change over time due to a parasitic capacitance and a wiring capacitance by fixing the gate potential of the driving transistor 53. Therefore, the potential of the second power supply line 60 is preferably fixed at least when a forward voltage is applied.

The controlling circuit 118 includes two n-channel transistors in which the first electrode of a first n-channel transistor 61 and the gate electrode of a second n-channel transistor 62 are connected to the anode line 18. The second electrode of the first n-channel transistor 61 and the first electrode of the second n-channel transistor 62 are connected to the second power supply line 60. The potential of the gate electrode of the first n-channel transistor 61 is maintained at −2 V while the potential of the second electrode of the second n-channel transistor 62 is maintained at 0 V.

In such controlling circuit 118, the first n-channel transistor 61 is turned OFF and the second n-channel transistor 62 is turned ON when a forward voltage is applied. As a result, the potential of the gate electrode of the driving transistor 53 becomes 0 V.

Accordingly, the driving transistor 53 is turned ON and a forward voltage is applied to a light emitting element since the cathode line 69 has a potential of −2 V and the anode line 18 has a potential of 5 V. Thus, the light emitting element emits light.

Figure 1B:
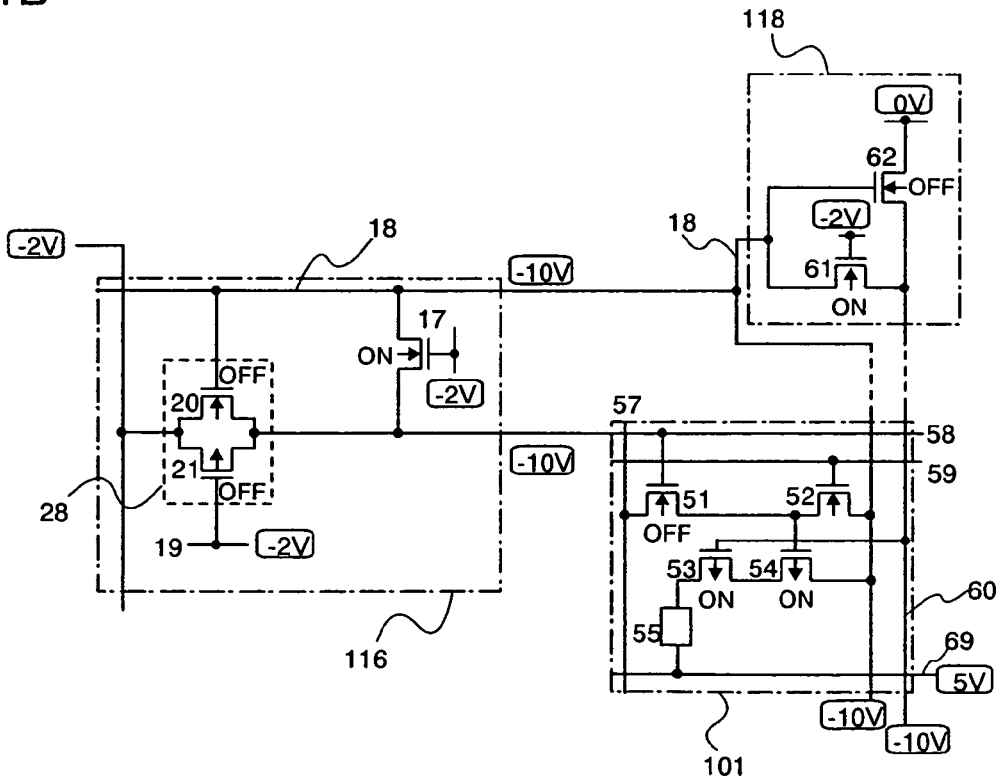

FIG. 1B shows a state in which a reverse voltage is applied. In this embodiment mode, the potential of the anode line 18 is −10 V and the potential of the first power supply line 19 is −2 V. Then, the n-channel transistor 20 and the p-channel transistor 21 in the analog switch 28 are both turned OFF. The reverse voltage applying transistor 17 is turned ON and the potential of the scan line 58 becomes −10 V. Accordingly, the switching transistor 51 is turned OFF in the pixel 101.

At this time, a reverse voltage is applied when the potential of the cathode line 69 is −10 V. The reverse voltage is efficiently applied by turning ON the driving transistor 53 and the current controlling transistor 54. The driving transistor 53 which is designed so that L/W thereof becomes large for operating in a saturation region might have a high resistance. Therefore, the first n-channel transistor 61 is turned ON and the second n-channel transistor 62 is turned OFF in the controlling circuit 118 so that the potential of the second power supply line 60 connected to the gate electrode of the driving transistor 53 becomes −10 V. Thus, a reverse voltage can be efficiently applied with a high gate voltage applied to the gate electrode of the driving transistor 53. The problem that the reverse voltage is required to be applied for a long time because of the resistance of the driving transistor 53 is thus reduced.

The driving transistor 53 may operate in a linear region as well. When the driving transistor 53 operates in a linear region, driving voltage can be low. Therefore, low power consumption of a display device can be expected.

In the aforementioned state, the driving transistor 53 and the current controlling transistor 54 are turned ON and the potential of the cathode line 69 is −2 V and the potential of the anode line 18 is −10 V. Therefore, a reverse voltage is applied to the light emitting element.

In order to offset the resistances of the driving transistor 53 and the current controlling transistor 54, a diode may be provided between the first electrode (the anode in this embodiment mode) of the light emitting element and the anode line 18. It should be noted that the first electrode of the light emitting element is the anode in this embodiment mode, however, it may be the cathode as well.

According to this embodiment mode, a circuit configuration for applying a reverse voltage for enhancing the reliability by controlling the degradation of the light emitting element in a display device having a novel pixel circuit, and a method thereof can be provided.

According to this embodiment mode, a reverse voltage can be applied without short-circuiting the anode line and the signal line, that are the anode line and the power supply line of a signal driver circuit.

Note that the potentials described in this embodiment mode are only an example and the invention is not limited to this.

EMBODIMENT MODE 2

In this embodiment mode, a specific example is described that a reverse voltage applying circuit including a clocked inverter is used.

Figure 2A:
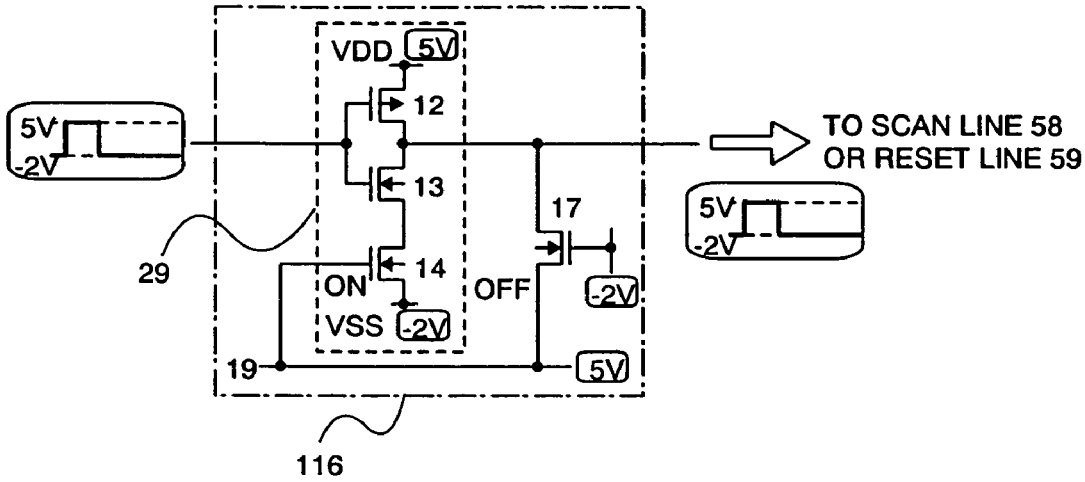
FIGS. 2A and 2B are diagrams describing the display device of the invention and the driving method thereof.

FIG. 2A shows a state in which a forward voltage is applied. The reverse voltage applying circuit 116 shown in FIG. 2A includes a clocked inverter 29 having a p-channel transistor 12 and n-channel transistors 13 and 14 connected in series. Note that a clocked inverter having a p-channel transistor may be used additionally. The gate electrode of the p-channel transistor 12 and the gate electrode of the n-channel transistor 13 have the same potentials, that is, connected to each other. The first electrode of the p-channel transistor 12 is connected to a power supply line of which potential is maintained constant, for example VDD (a power supply line on the high potential side) of which potential is maintained at 5 V. The first electrode of the n-channel transistor 14 is connected to a power supply line of which potential is maintained constant, for example VSS (a power supply line on the low potential side) of which potential is maintained at −2 V. The gate electrode of the n-channel transistor 14 is connected to a power supply line of which potential is maintained constant, or to a cathode line. In this embodiment mode, it is connected to the first power supply line 19 of which potential is maintained at 5 V. An output wiring of the clocked inverter 29 is connected to the first electrode of the reverse voltage applying transistor 17 and to the scan line 58 or the reset line 59. In this embodiment mode, the output wiring of the clocked inverter 29 is connected to the first electrode of the reverse voltage applying transistor 17 and the scan line 58.

The gate electrode of the reverse voltage applying transistor 17 is connected to a power supply line of which potential is maintained constant or to the cathode line. The first electrode of the reverse voltage applying transistor 17 is connected to the anode line and the second electrode thereof is connected to the output wiring of the clocked inverter 29. The potential of the gate electrode of the reverse voltage applying transistor 17 is maintained at −2 V in this embodiment mode. The first electrode of the reverse voltage applying transistor 17 is connected to the output wiring of the clocked inverter 29 and the second electrode thereof is connected to the first power supply line 19. Further, the first electrode of the reverse voltage applying transistor 17 is connected to the scan line connected to the gate electrode of the switching transistor. The first electrode of the reverse voltage applying transistor may be connected to the reset line 59 connected to the gate electrode of the erasing transistor.

Provided that pulse signals of −2 and 5V is outputted from a buffer circuit in a scan driver circuit to the clocked inverter 29, the n-channel transistor 14 is turned ON and the reverse voltage applying transistor 17 is turned OFF.

As a result, the signal outputted from the buffer circuit is inputted to the scan line 58. In this embodiment mode, the switching transistor 51 is an n-channel transistor and a video signal is inputted as a voltage. Then, the driving transistor 53 and the current controlling transistor 54 are turned ON as in Embodiment Mode 1, thus the light emitting element 55 emits light.

The other pixel circuit and operation, and the controlling circuit 118 are similar to the ones in FIG. 1A, therefore, the description is omitted here. Note that a voltage Vgs between the gate and source of the driving transistor does not change over time due to a parasitic capacitance and a wiring capacitance by fixing the potential of the gate electrode of the driving transistor. Therefore, the potential of the second power supply line 60 is preferably fixed at least when a forward voltage is applied as described in Embodiment Mode 1.

At this time, an erasing period for selecting the reset line 59 is provided as required by operating the erasing transistor 52 in order to display a high level gray scale. In this embodiment mode, the erasing transistor 52 is an n-channel transistor. For further details of the erasing transistor and the operation thereof, refer to Japanese Patent Application Laid-open No. 2001-343933.

Accordingly, the driving transistor 53 is turned ON and a forward voltage is applied to a light emitting element since the cathode line 69 has a potential of 10 V and the anode line 18 has a potential of 5 V. Thus, the light emitting element emits light.

Figure 2B:
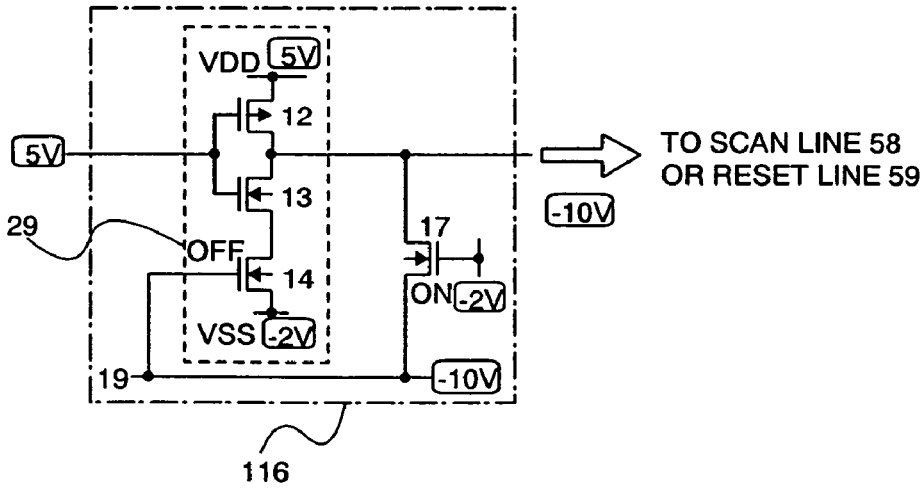

FIG. 2B shows a state in which a reverse voltage is applied. The potential of the first power supply line 19 is maintained at −10 V. Then, the n-channel transistor 14 in the clocked inverter 29 has the high impedance as it is turned OFF. The reverse voltage applying transistor 17 is turned ON and the potential of the scan line 58 becomes −10 V. Accordingly, the switching transistor 51 is turned OFF in the pixel 101.

In order to apply a reverse voltage efficiently, the driving transistor 53 and the current controlling transistor 54 are turned ON. By using the controlling circuit 118 which is similar to the one described in Embodiment Mode 1, the first n-channel transistor 61 is turned ON and the second n-channel transistor 62 is turned OFF so that the potential of the second power supply line 60 connected to the gate electrode of the driving transistor 53 becomes −10 V.

Accordingly, the driving transistor 53 is turned ON and a reverse voltage is applied to the light emitting element since the cathode line 69 has a potential of 5 V and the anode line 18 has a potential of −10 V.

In order to offset the resistance of the driving transistor 53 and the current controlling transistor 54, a diode may be provided between the first electrode of the light emitting element and the anode line 18.

According to this embodiment mode, a circuit configuration for applying a reverse voltage for enhancing the reliability by controlling the degradation of the light emitting element in a display device having a novel pixel circuit, and a method thereof can be provided.

According to this embodiment mode, a reverse voltage can be applied without short-circuiting the anode line and the signal line, that are the anode line and the power supply line of a signal driver circuit.

Note that the potentials described in this embodiment mode are only an example and the invention is not limited to this.

EMBODIMENT MODE 3

Described in this embodiment mode is a scan driver circuit and a signal driver circuit each having the reverse voltage applying circuit, and a display device having these circuits.

Figure 5A:
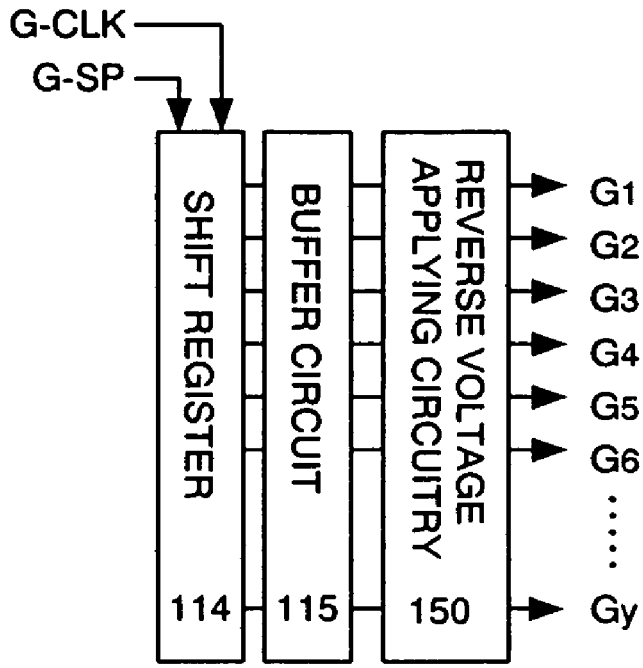
FIGS. 5A and 5B are diagrams describing the display device of the invention and the driving method thereof.

FIG. 5A shows a configuration of the scan driver circuit including a shift register 114, a buffer 115, and a reverse voltage applying circuitry 150 having the reverse voltage applying circuit 116.

The reverse voltage applying circuitry 150 includes the reverse voltage applying transistor 17 and a plurality of reverse voltage applying circuits 116 each of which is connected to a scan line or a reset line. The reverse voltage applying circuit 116 includes the analog switch 28 or the clocked inverter 29.

When the reverse voltage applying circuitry 150 is provided in the scan driver circuit, the potential of the anode line and the potential of the power supply line of which potential is maintained constant or of the cathode line are inverted. The analog switch 28 or the clocked inverter 29 is turned OFF simultaneously with applying a reverse voltage to the light emitting element so that the reverse voltage applying transistor 17 is turned ON. The appropriate potential is outputted so the switching transistor 51 or the erasing transistor 52 can be turned OFF in the pixel connected to the reverse voltage applying circuit 116. As a result, a reverse voltage can be applied without short-circuiting the anode line 18 and the signal line 57, that are the anode line and the power supply line of the signal driver circuit.

Figure 5B:
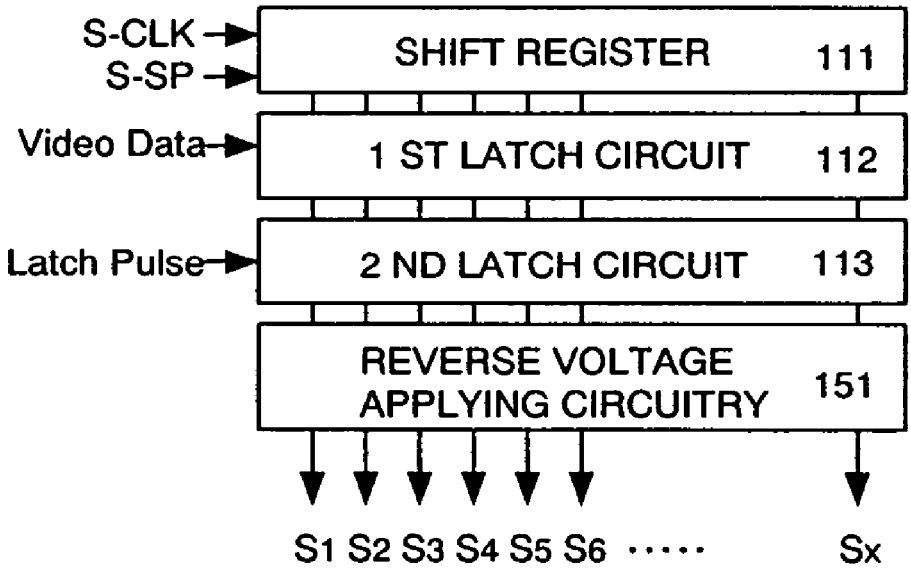

The reverse voltage applying circuit 116 may be provided in the signal driver circuit as well. FIG. 5B shows a configuration of the signal driver circuit including a shift register 111, a first latch circuit 112, a second latch circuit 113, and a reverse voltage applying circuitry 151 having a plurality of reverse voltage applying circuits 116.

The reverse voltage applying circuit 116 provided in the signal driver circuit includes the analog switch 28 or the clocked inverter 29 and does not require the reverse voltage applying transistor 17 any more. The output wiring of the analog switch 28 or the clocked inverter 29 is connected to a plurality of signal lines (S1 to Sx) in a pixel portion respectively.

Further, the reverse voltage applying circuit 116 provided in the signal driver circuit includes a switch for preventing short-circuit of a power supply line of the signal driver circuit and the anode line. The switch is turned ON or OFF by the potential difference between the anode line and the power supply line of which potential is maintained constant or the cathode line.

In a display device having the reverse voltage applying circuitry 150 in the signal driver circuit, the potential of the anode line and the potential of the power supply line of which potential is maintained constant or of the cathode line are inverted. The analog switch or the clocked inverter is turned OFF simultaneously with applying a reverse voltage to the light emitting element so that a transistor disposed between the anode line and the signal line is turned OFF. As a result, a reverse voltage can be applied without short-circuiting the anode line and the signal line, that are the anode line and the power supply line of the signal driver circuit.

The potentials of the anode line and of the power supply line connected to the gate electrode of the driving transistor when a reverse voltage is applied are described. When applying a reverse voltage, it is applied to the light emitting element via the driving transistor and the current controlling transistor. Therefore, the resistances of the driving transistor and the current controlling transistor are preferably small. In the case where the driving transistor operates in a saturation region, in particular, resistance may be large since L/W of the channel forming region becomes large.

In order to turn ON the driving transistor and the current controlling transistor without fail and to apply as high voltage as possible, the controlling circuit 118 for controlling the potential of the power supply line connected to the gate electrode of the driving transistor is provided.

The controlling circuit 118 includes a sixth transistor of which gate electrode is connected to the anode line and the first electrode thereof is connected to a power supply line, and a seventh transistor of which gate electrode is maintained at a constant potential and the first electrode thereof is connected to the anode line and the second electrode thereof is connected to the power supply line.

When applying a forward voltage to the driving transistor, the sixth transistor is turned ON and the seventh transistor is turned OFF. When applying a reverse voltage to the driving transistor, the sixth transistor is turned OFF and the seventh transistor is turned ON. A reverse voltage to be applied to the driving transistor can be high by making the absolute value of the potential of the power supply line large.

Figure 12A:
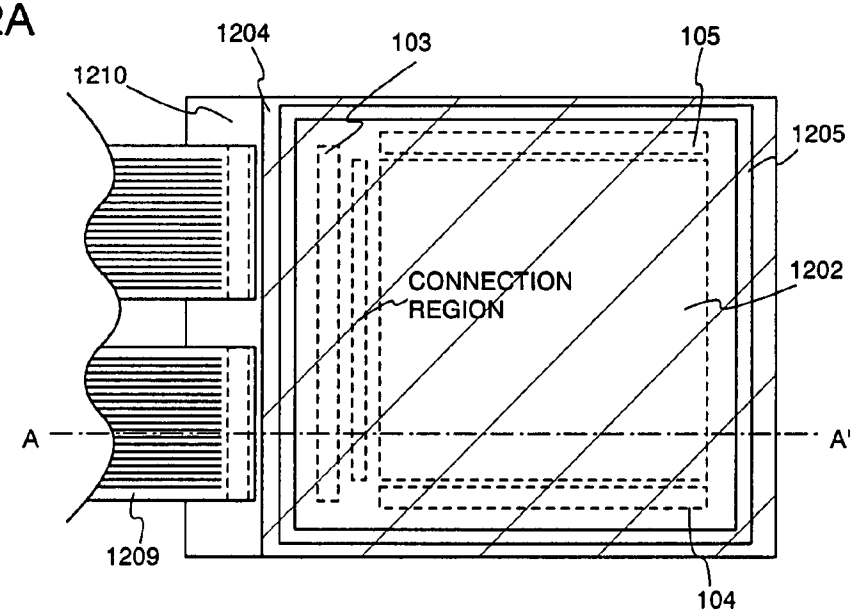
FIGS. 12A is a top plan view and 12B is a cross-sectional view of the display device of the invention.

FIG. 12A shows a top plan view of a display device having the signal driver circuit and the scan driver circuit as described above. A signal driver circuit 103, scan driver circuits 104 and 105, and a pixel portion 1202 are mounted on a first substrate 1210.

Figure 12B:
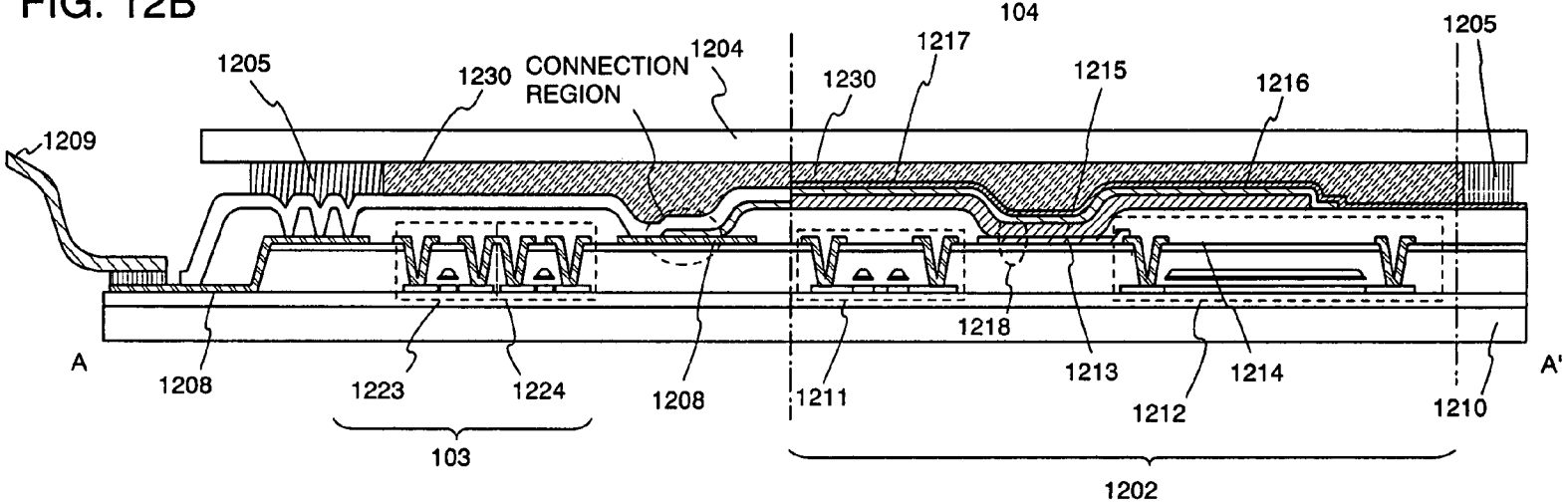

FIG. 12B is a cross-sectional view taken by cutting along a line A-A' of a display device having a light emitting element. A signal driver circuit 1201 provided with a CMOS circuit having an n-channel TFT 1223 and a p-channel TFT 1224 is mounted on the first substrate 1210. Further, TFTs forming the signal driver circuit and the scan driver circuit may form a CMOS circuit, a PMOS circuit or an NMOS circuit. In this embodiment mode, the signal driver circuit and the scan driver circuit are integrally formed on the substrate, however, the scan driver circuit and the signal driver circuit may be formed into ICs and connected to a signal line or a scan line by COG or TAB.

A pixel portion 1202 includes a switching transistor 1211 and a driving transistor 1212, an insulator 1214 covering the switching transistor and the driving transistor and having apertures at predetermined positions, a light emitting element 1218 having a first electrode 1213 of a light emitting element connected to one wiring of the driving transistor 1212, an organic light emitting layer 1215 provided on the first electrode, and a second electrode 1216, and a protective layer 1217 provided for preventing the degradation of the light emitting element due to moisture, oxygen and the like.

In this embodiment mode, the protective layer 1217 is formed by a silicon nitride or silicon oxynitride based insulating film formed by sputtering (DC method and RF method), or a DLC film (Diamond Like Carbon) containing nitrogen.

As the first electrode 1213 of the light emitting element contacts the first electrode of the driving transistor 1212, at least the bottom part of the first electrode 1213 of the light emitting element is preferably formed of a material which can give an ohmic contact with the drain region of the semiconductor film, and a surface contacting with the organic light emitting layer is preferably formed by using a material of large work function. Further, The first electrode 1213 of the light emitting element may be a single layer of titanium nitride film or a lamination of three or more layers. Further, by using a transparent conductive film as the first electrode 1213 of the light emitting element, a display device having a dual emission light emitting element can be fabricated.

The insulator 1214 may be formed by using an organic resin film or an insulating film including silicon. Here, a positive photosensitive acrylic resin film is used for forming the insulator 1214.

In order that electrodes and an organic light emitting layer to be formed in subsequent steps may have good step coverage, the insulator 1214 is preferably formed so that the top part or the bottom part thereof has a curve having a curvature. In the case of using positive photosensitive acrylic as a material for forming the insulator 1214, for example, the top part of the insulator 1214 only can have a curvature radius (0.2 to 3 μm). Further, the insulator 1214 may be a negative type which becomes insoluble in etchant when exposed to photosensitive light or a positive type which becomes soluble in etchant when exposed to light.

The organic light emitting layer 1215 which emits light of RGB is selectively formed on the first electrode 1213 by vapor deposition with a vapor deposition mask or by ink-jetting.

In the case where the light emitting element 1218 emits white light, a color filter having a colored layer and a black matrix (BM) layer are required.

The second electrode 1216 is connected to a connection wiring 1208 through an aperture provided on the insulator 1214 of the connected region. The connection wiring 1208 is connected to a flexible printed substrate (FPC) 1209 by anisotropic conductive resin (ACF). Video signals and clock signals are supplied through the FPC 1209 as an external input terminal. The FPC only is shown here, however, a printed wiring substrate (PWB) may be connected thereto.

When connecting ACF by applying pressure or heat, it should be taken notice that a crack may not occur due to the flexibility of the film substrate or getting softened by heat. For example, a hard substrate may be disposed at the connected region as a support.

A sealing material 1205 is provided along the peripheral edge of the first film substrate for sealing by bonding a second substrate 1204. The sealing material 1205 is preferably formed of epoxy resin.

A space is formed between the second substrate 1204 and the protective layer 1217 by bonding. The space is protected from moisture or oxygen by filling inert gas such as nitrogen gas or forming a high moisture absorbent member. In this embodiment mode, a resin 1230 which has high moisture absorbent and transmits light is formed. As the resin 1230 transmits light, it can be used without decreasing the transmittance of the light emitted to the second substrate side from the light emitting element.

According to this embodiment mode, a circuit configuration for applying a reverse voltage for enhancing the reliability by controlling the degradation of the light emitting element in a display device having a novel pixel circuit, and a method thereof. Further, a reverse voltage can be applied without short-circuiting the anode line and the signal line, that are the anode line and the power supply line of a signal driver circuit. Thus, the life of a display device is extended.

EMBODIMENT MODE 4

Figure 3A:
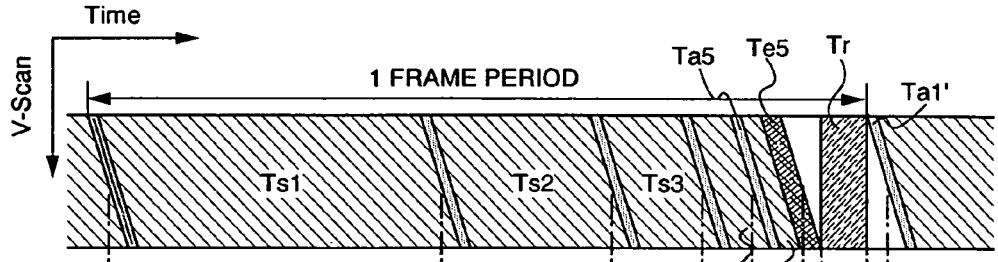
FIGS. 3A to 3C are timing charts of the invention.
Figure 3B:
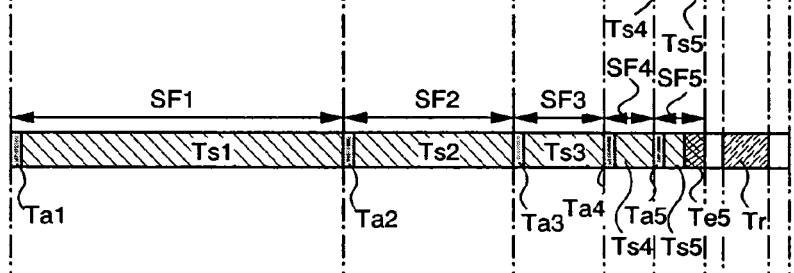

When the display device of the invention is driven digitally, time gray scale method is used in order to display a multilevel gray scale image. In this embodiment mode, timing at which a reverse voltage is applied is shown with reference to FIGS. 3. FIG. 3A is a timing chart of which vertical axis corresponds to a scan line, the horizontal axis corresponds to time. FIG. 3B is a timing chart of a scan line Gj in a j-th line.

The frame frequency of the display device is typically set about 60 Hz though it depends on the display device specification. That is, a picture is drawn 60 times in one second. A period in which a picture is drawn once is referred to as one frame period (unit frame period). In the time gray scale method, one frame period is divided into a plurality of sub-frame periods (m (m is a natural number of 2 or more) sub-frame periods SF1, SF2, . . . , SFm). At this time, one frame period is often divided into the same number as the gray scale bit, which is the case described here for simplicity. That is to say, 5-bit gray scale is described in this embodiment mode, therefore, one frame period is divided into five sub-frame periods SF1 to SF5.

Each sub-frame period has a writing period Ta1, Ta2, . . . , Tam for writing a video signal into a pixel, and a storing period Ts1, Ts2, . . . , Tsm in which a light emitting element emits light or does not emit light. The lengths of the storing periods Ts1 to Ts5 are in the proportion of Ts1: . . . :Ts5=16:8:4:2:1. That is, when displaying n-bit gray scale, n storing periods have their lengths in the proportion of $2^{(n-1)}$: $2^{(n-2)}$: . . . :$2^1$:$2^0$.

Figure 3C:
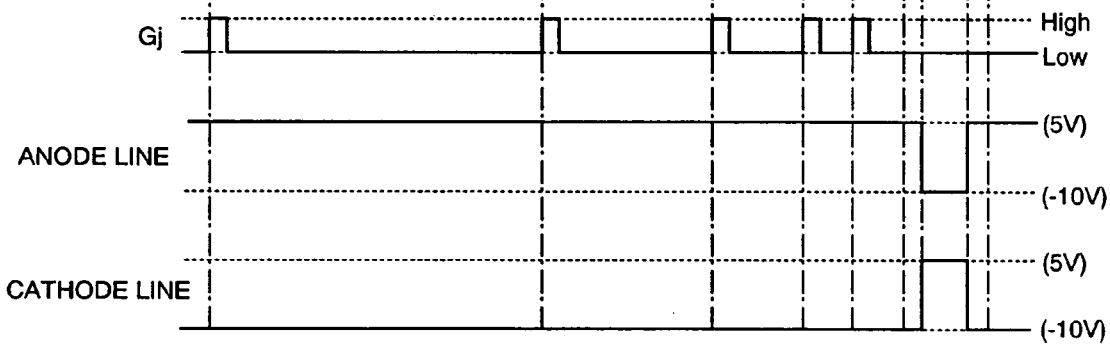

In FIGS. 3A to 3C, the sub-frame period SF5 has an erasing period Te5. The video signal written in the pixel is reset in the erasing period Te5. The erasing period may be provided as required.

A reverse voltage applying period Tr is provided in one frame period. In the reverse voltage applying period Tr, reverse voltage is applied to all the pixels simultaneously. In this embodiment mode, the reverse voltage applying period Tr is provided after the erasing period Te5. It is preferable that the reverse voltage applying period Tr be long so that a reverse voltage is applied to the light emitting element for a long time.

FIG. 3C shows voltages of the scan line Gj, the anode line, and the cathode line which correspond to FIG. 3B. As shown in FIG. 3C, High and Low pulse signals are applied to the scan line Gj. For example, signals of 5 V and −2 V are applied as described in Embodiment Mode 1 or 2. A High signal is applied to the scan line Gj in the writing periods Ta1 to Ta5, while a Low signal is applied in the reverse voltage applying period Tr.

A voltage of 5 V is applied to the anode line and a voltage of −2 V is applied to the cathode line, while a voltage of −2 V is applied to the anode line and a voltage of 5 V is applied to the cathode line in the reverse voltage applying period Tr.

When the levels of gray scale are to be increased, one frame may be divided into more sub-frame periods. Further, the order of the sub-frame periods does not necessarily start from the most significant bit to the least significant bit, but may be randomly ordered in one frame. The order may be different depending on the frame period. A sub-frame period may be further divided as well.

A reverse voltage may be selectively applied to each pixel. In this case, a switch is provided in each pixel so that it is controlled to be turned OFF when a reverse voltage is not applied.

Further, degradation of a light emitting element may be different depending on each pixel. Based on the data obtained by counting and recording the video signal by a memory circuit and a counter circuit, a reverse voltage to be applied may be determined according to the degradation of the light emitting element. The potential of the anode line and the power supply line of which potential is maintained constant or the cathode line may be set according to the applied reverse voltage. For example, the potential of the anode line which is provided to each light emitting element is set in each pixel.

This embodiment mode can be freely combined with the aforementioned embodiment modes.

EMBODIMENT MODE 5

In this embodiment mode, a pixel circuit and the operation thereof are described.

Figure 4A:
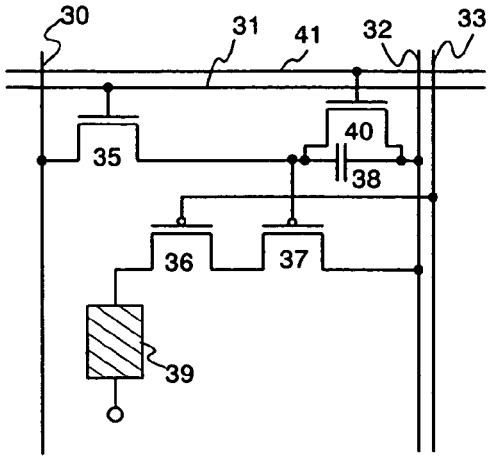
FIGS. 4A to 4F are diagrams describing the pixel circuits of the display device of the invention.

A pixel circuit shown in FIG. 4A includes a light emitting element 39, a signal line 30 to which a video signal is inputted, a switching transistor 35 for controlling an input of a video signal to the pixel, a driving transistor 36 for controlling the amount of a current to be supplied to the light emitting element 39, a current controlling transistor 37 for controlling a current supply to the light emitting element 39, an erasing transistor 40 for erasing the potential of the written video signal, and a capacitor 38 for storing the potential of the video signal.

In this embodiment mode, the switching transistor 35 and the erasing transistor 40 are n-channel transistors while the driving transistor 36 and the current controlling transistor 37 are p-channel transistors. The driving transistor 36 operates in a saturation region and the current controlling transistor 37 operates in a linear region. Therefore, the driving transistor 36 is formed so that L of the channel forming region is longer than W thereof, preferably L is five times or more the length of W. Each transistor may be either an enhancement transistor or a depletion transistor.

The driving transistor 36 may operate in a linear region. When the driving transistor 36 operates in a linear region, the driving voltage can be lowered. Therefore, low power consumption of the display device can be expected.

The gate electrode of the switching transistor 35 is connected to a scan line 31. The first electrode of the switching transistor 35 is connected to a signal line 30 and the second electrode thereof is connected to the gate electrode of the current controlling transistor 37. The gate of the driving transistor 36 is connected to a second power supply line 33. The driving transistor 36 and the current controlling transistor 37 are connected to a first power supply line 32 and the light emitting element 39 so that the current supplied from the first power supply line 32 is supplied to the light emitting element 39 as a drain current of the driving transistor 36 and the current controlling transistor 39.

One of the two electrodes of the capacitor 38 is connected to the first power supply line 32 and the other is connected to the gate of the current controlling transistor 37. The capacitor 38 is provided so as to hold the potential difference between the electrodes of the capacitor 38 when the switching transistor 35 is not selected (OFF state). The capacitor 38 does not have to be provided when the gate capacitance of the switching transistor 35, the driving transistor 36, or the current controlling transistor 37 is large enough and the leak current from each transistor is within an allowance.

The gate electrode of the erasing transistor 40 is connected to a reset line 41, the first electrode thereof is connected to the first power supply line 32, the second electrode thereof is connected to the gate of the current controlling transistor 37. That is, the first electrode and the second electrode of the erasing transistor 40 are connected to each end of the capacitor 38.

The operation of a pixel shown in FIG. 4A is described in three periods: wiring period, light emitting period, and erasing period. First, the switching transistor 35 connected to the scan line 31 is turned ON when the scan line 31 is selected in the writing period. Then, a video signal inputted to the signal line 30 is inputted to the gate of the current controlling transistor 37 via the switching transistor 35. It should be noted that the driving transistor 36 can be controlled separately from the current controlling transistor 37 as the gate of the driving transistor 36 is connected to the second power supply line 33.

When the current controlling transistor 37 is turned ON by a video signal, current is supplied to the light emitting element 39 via the first power supply line 32. At this time, current supplied to the light emitting element 39 is determined by V-I characteristics of the driving transistor operating in a saturation region and the light emitting element 39 since the current controlling transistor 37 operates in a linear region. The light emitting element 39 emits light at a luminance according to the supplied current.

In the case where the current controlling transistor 37 is turned OFF by a video signal, current is not supplied to the light emitting element 39.

The switching transistor 35 is turned OFF by controlling the potential of the scan line 31 and the potential of the video signal written in the writing period is held in the storing period. When the current controlling transistor 37 is turned ON in the writing period, the light emitting element 39 keeps emitting light because the potential of the video signal is held in the capacitor 38 and current supply to the light emitting element 39 is maintained. On the other hand, when the current transistor 37 is turned OFF in the writing period, the potential of the video signal is held in the capacitor 38 and the current is not supplied to the light emitting element 39. Therefore, the light emitting element 39 does not emit light.

In the erasing period, the erasing transistor 40 is turned ON when a second scan line 41 which corresponds to the reset line is selected. The potential of the first power supply line 32 is supplied to the gate of the current controlling transistor 37 via the erasing transistor 40. Therefore, the current controlling transistor 37 is turned OFF. Thus, a condition that the light emitting element 39 is not supplied current is forcibly created.

In the reverse voltage applying period, the driving transistor 36 and the current controlling transistor 37 are turned ON as shown in FIGS. 1B and 2B so that a reverse voltage is applied to the light emitting element.

A timing chart of the writing period, storing period, erasing period, and reverse voltage applying period can be referred in Embodiment Mode 4.

Figure 4B:
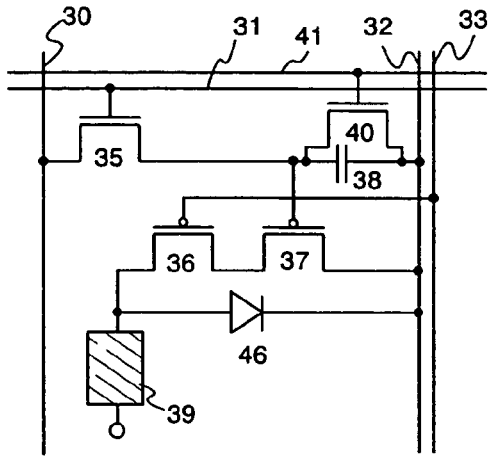

A pixel circuit shown in FIG. 4B is different from the pixel circuit shown in FIG. 4A in the respect that a diode 46 is provided between the light emitting element 39 and the first power supply line 32.

A reverse voltage can be applied via the diode 46 which is lower in resistance than the case that the driving transistor 36 and the current controlling transistor 37 are ON. As a result, a reverse voltage can be applied efficiently. Further, the time required for applying the reverse voltage can be short, thus the writing period and the storing period can be provided long.

Figure 4C:
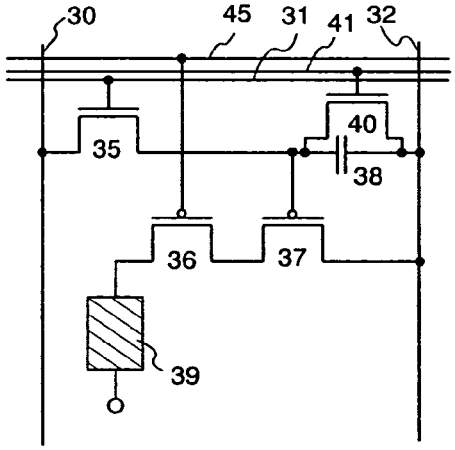

A pixel circuit shown in FIG. 4C is different from the pixel circuit shown in FIG. 4A in the respect that the gate electrode of the driving transistor 36 is connected to a third scan line 45 provided in parallel to the scan line. Therefore, the light emitting element 39 is controlled by a pulse signal applied to the third scan line 45.

The other configuration thereof is the same as the one in FIG. 4A, therefore, the description is omitted here.

Figure 4D:
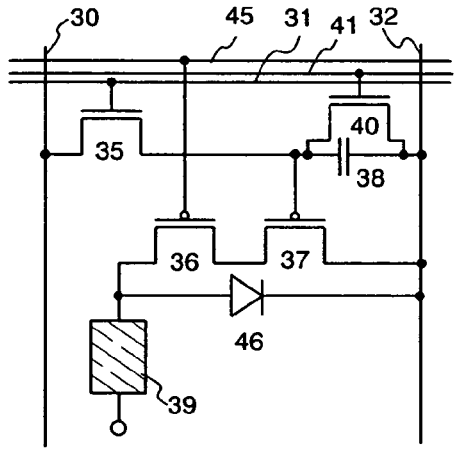

A pixel circuit shown in FIG. 4D is different from the pixel circuit shown in FIG. 4C in the respect that the diode 46 is provided between the light emitting element 39 and the first power supply line 32.

A reverse voltage can be applied via the diode 46 which is lower in resistance than the case that the driving transistor 36 and the current controlling transistor 37 are ON. As a result, a reverse voltage can be applied efficiently. Further, the time required for applying the reverse voltage can be short, thus the writing period and the storing period can be provided long.

The other configuration thereof is the same as the one in FIG. 4C, therefore, the description is omitted here.

Figure 4E:
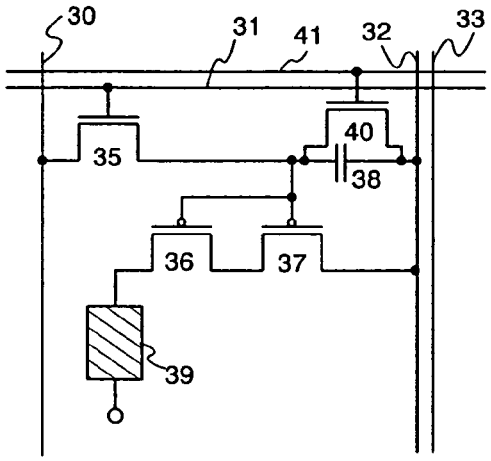

A pixel circuit shown in FIG. 4E is different from the pixel circuit shown in FIG. 4A in the respect that the gate electrode of the driving transistor 36 and the gate electrode of the current controlling transistor 37 are common. Therefore, the driving transistor 36 and the current controlling transistor 37 of the different characteristics are to be used when controlling them separately. In FIG. 4E, the driving transistor 36 is a depletion transistor and the current controlling transistor 37 is an enhancement transistor.

The other configuration thereof is the same as the one in FIG. 4A, therefore, the description is omitted here.

Figure 4F:
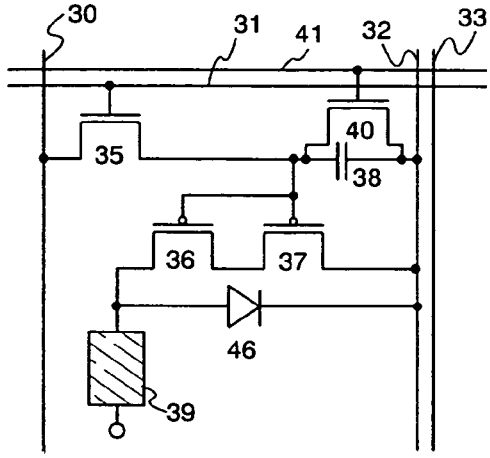

A pixel circuit shown in FIG. 4F is different from the pixel circuit shown in FIG. 4A in the respect that the diode 46 is provided between the light emitting element 39 and the first power supply line 32.

A reverse voltage can be applied via the diode 46 which is lower in resistance than the case that the driving transistor 36 and the current controlling transistor 37 are ON. As a result, a reverse voltage can be applied efficiently. Further, the time required for applying the reverse voltage can be short, thus the writing period and the storing period can be provided long.

The other configuration thereof is the same as the one in FIG. 4E, therefore, the description is omitted here.

As described in this embodiment mode, the invention can have various pixel configurations to which a reverse voltage can be applied. Accordingly, the life of a display device is extended.

EMBODIMENT MODE 6

In this embodiment mode, a specific mask layout of each pixel circuit is described.

Figure 6:
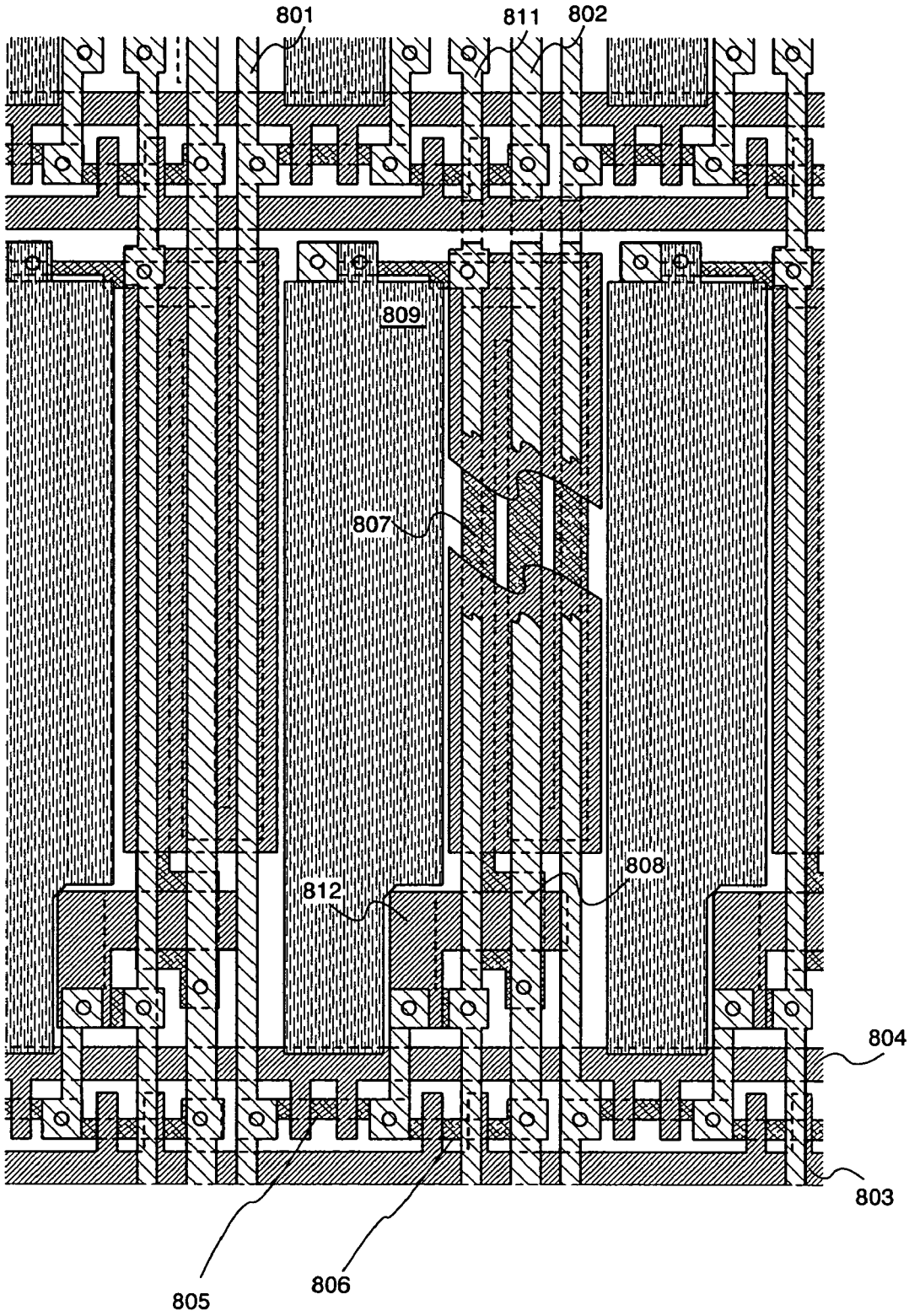
FIG. 6 is a top plan view of the pixel of the display device of the invention.

In FIG. 6, a signal line 801, a first power supply line 802, a second scan line 803, a first scan line 804, a switching transistor 805, an erasing transistor 806, a driving transistor 807, a current controlling transistor 808, a first electrode 809 of the light emitting element, a second power supply line 811, and a capacitor 812 are provided.

In this embodiment mode, the second power supply line 811 is provided in parallel to the first power supply line 802. The second power supply line 811 is connected to the gate electrode of the driving transistor 807. The switching transistor 805 and the erasing transistor 806 have double gate structures in which two gate electrodes are provided to a semiconductor layer. The first scan line 804 and the second scan line 803 each part of which are overlapped with the semiconductor layer function as gate electrodes of the switching transistor 805 and the erasing transistor 806. That is to say, the gate electrode of each transistor, the first scan line 804 and the second scan line 803 are formed by patterning the same first conductive film.

The signal line 801, the first power supply line 802, and the second power supply line 811 are formed by patterning the same second conductive film. The first electrode and the second electrode of each transistor are formed by the second conductive film.

The capacitor 812 has a laminated structure of at least a semiconductor film, a gate insulating film, and the first conductive film. A second electrode of the erasing transistor 806 and one electrode of the capacitor 812 are connected to the first power supply line 802. The charge held in the capacitor 812 is released when the erasing transistor 806 is turned ON.

The current controlling transistor 808 and the driving transistor 807 are formed to have the same conductivities. Their impurity regions are shared and their ON/OFF is controlled by each gate electrode. In the case of changing the characteristics of the current controlling transistor 808 and the driving transistor 807, for example, by using an enhancement transistor and a depletion transistor, different concentration of impurity may be doped.

In the case of sharing the gate electrodes of the current controlling transistor 808 and the driving transistor 807 as shown in FIGS. 4E and 4F, in particular, transistors of different characteristics are to be used.

It is shown that the second electrode of the driving transistor 807 and the first electrode 809 of the light emitting element are connected through a contact of the insulating layer, however, the first electrode 809 of the light emitting element may be formed on the second electrode of the driving transistor 807 as well.

When the driving transistor 807 operates in a saturation region, L/W thereof is designed to be larger than that of the current controlling transistor 808. For example, L/W of the driving transistor 807:L/W of the current controlling transistor 808=5 to 6000:1 is to be satisfied. Therefore, a semiconductor film of the driving transistor 807 is formed to have a strip shape in this embodiment mode.

Note that the driving transistor 53 may operate in a linear region. When the driving transistor 53 operates in a linear region, driving voltage can be low. Therefore, low power consumption of the display device can be expected.

Figure 7:
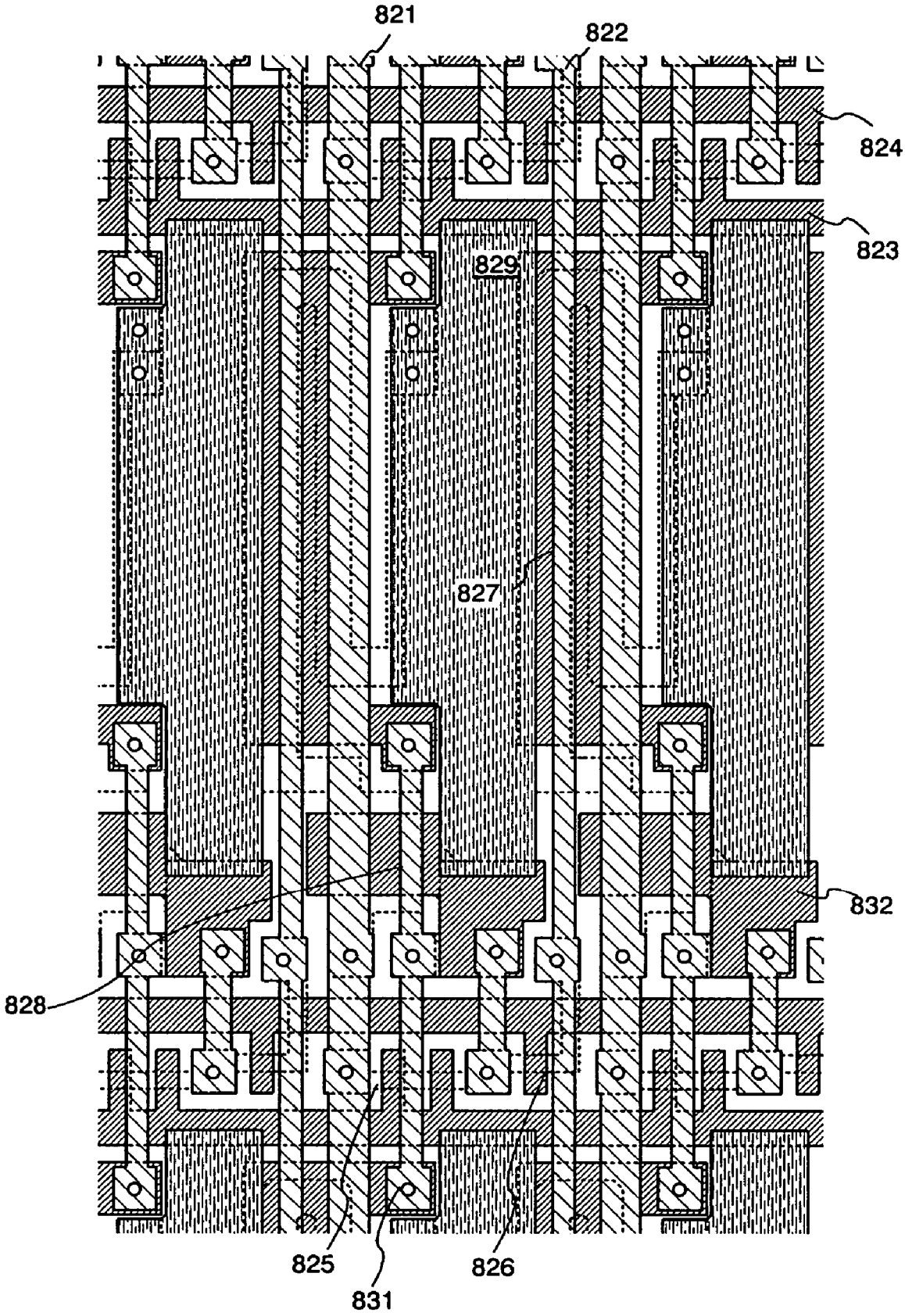
FIG. 7 is a top plan view of the pixel of the display device of the invention.

In FIG. 7, a signal line 821, a first power supply line 822, a second scan line 823, a first scan line 824, a switching transistor 825, an erasing transistor 826, a driving transistor 827, a current controlling transistor 828, a first electrode 829 of a light emitting element, a second power supply line 831, and a capacitor 832 are provided.

The top plan view shown in FIG. 7 is different from FIG. 6 in the respect of the second power supply line 831. In FIG. 7, driving transistors in adjacent pixels are connected by the first conductive film and the second power supply line 831. Specifically, components in the pixel are connected by using the first conductive film, while they are connected by using the second power supply line in adjacent pixels. The second power supply line 831 is provided between the first electrodes of the driving transistors 827 in adjacent pixels alternately. Therefore, wider apertures can be obtained in the configuration shown in FIG. 7 than the one shown in FIG. 6.

Figure 8:
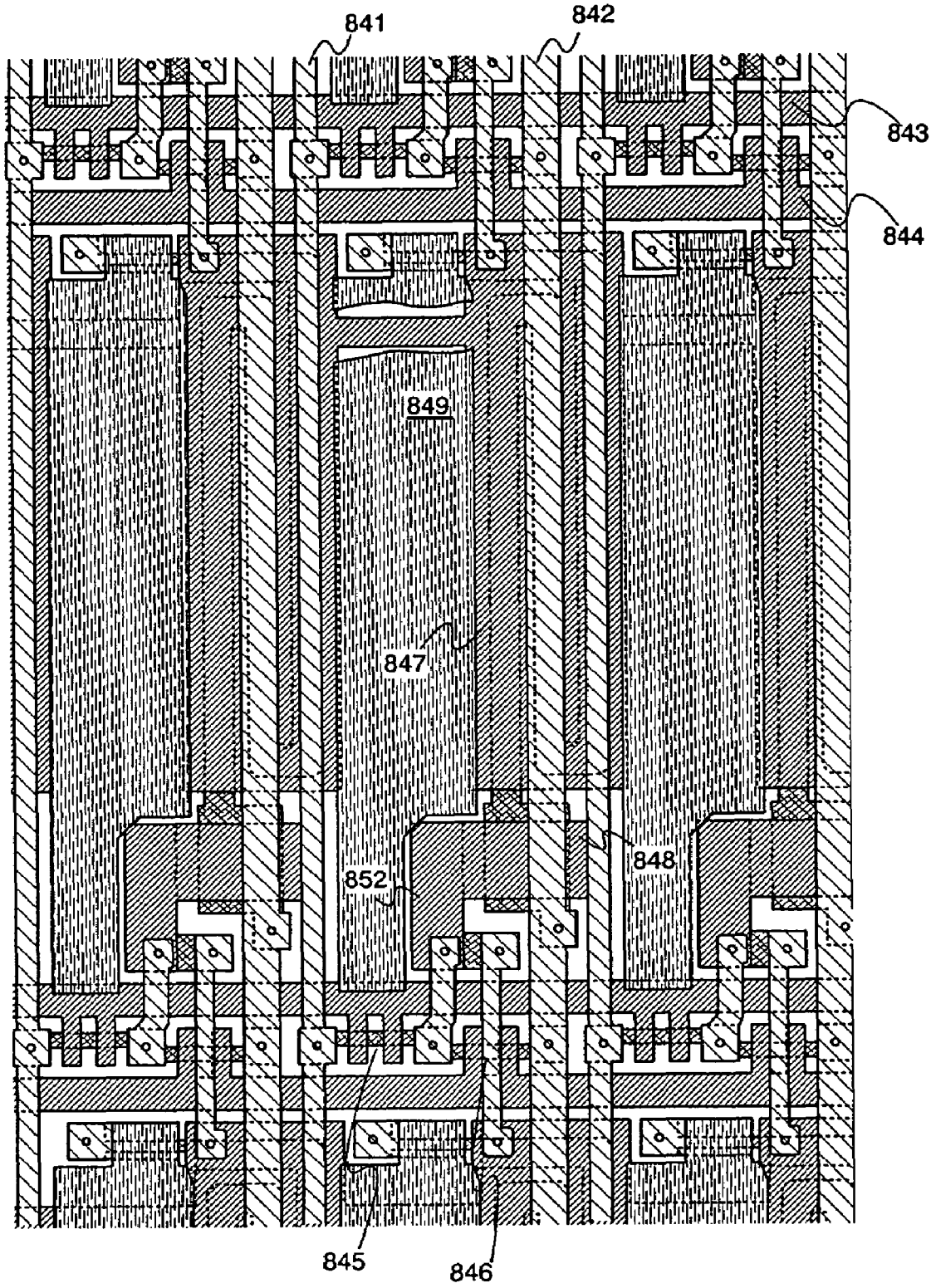
FIG. 8 is a top plan view of the pixel of the display device of the invention.

In FIG. 8, a signal line 841, a first power supply line 842, a second scan line 843, a first scan line 844, a switching transistor 845, an erasing transistor 846, a driving transistor 847, a current controlling transistor 848, the first electrode 849 of a light emitting element, and a capacitor 852 are provided.

In the top plan view of FIG. 8, the gate electrodes of the driving transistors 847 in adjacent pixels are connected to each other. The top plan view of FIG. 8 corresponds to the pixel circuit in which the gate electrode of the driving transistor is connected to the second scan line as shown in FIG. 4C.

Figure 9:
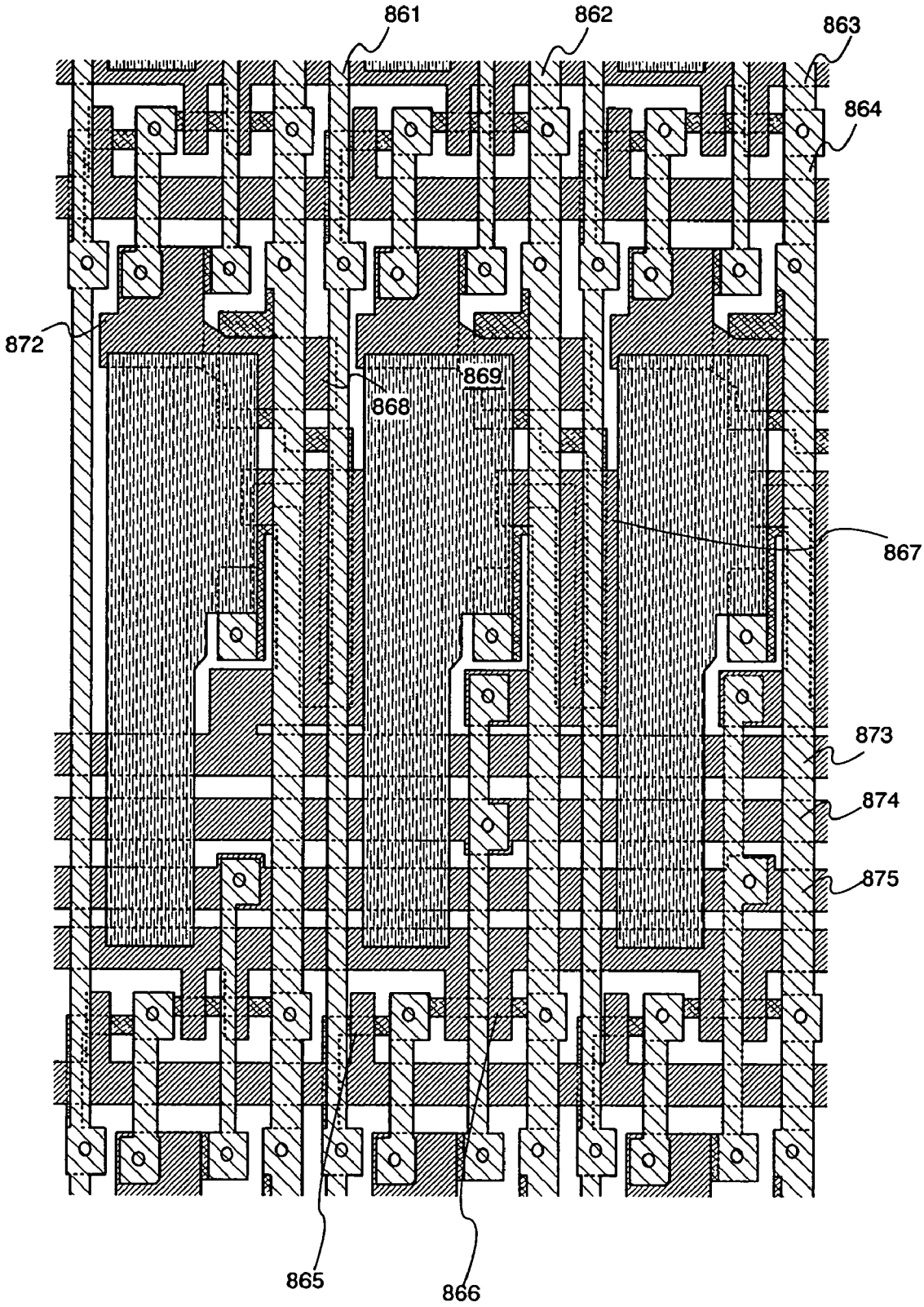
FIG. 9 is a top plan view of the pixel of the display device of the invention.

In FIG. 9, a signal line 861, a first power supply line 862, a second scan line 863, a first scan line 864, a third scan line 873, a fourth scan line 874, a fifth scan line 875, a switching transistor 865, an erasing transistor 866, a driving transistor 867, a current controlling transistor 868, the first electrode 869 of a light emitting element, and a capacitor 872 are provided.

In the top plan view shown in FIG. 9, the gate electrode of the driving transistor 867 in each pixel is connected to the third scan line 873, the fourth scan line 874, and the fifth scan line 875 respectively. Therefore, different voltage can be applied to the driving transistor 867 in each of RGB.

Figure 10:
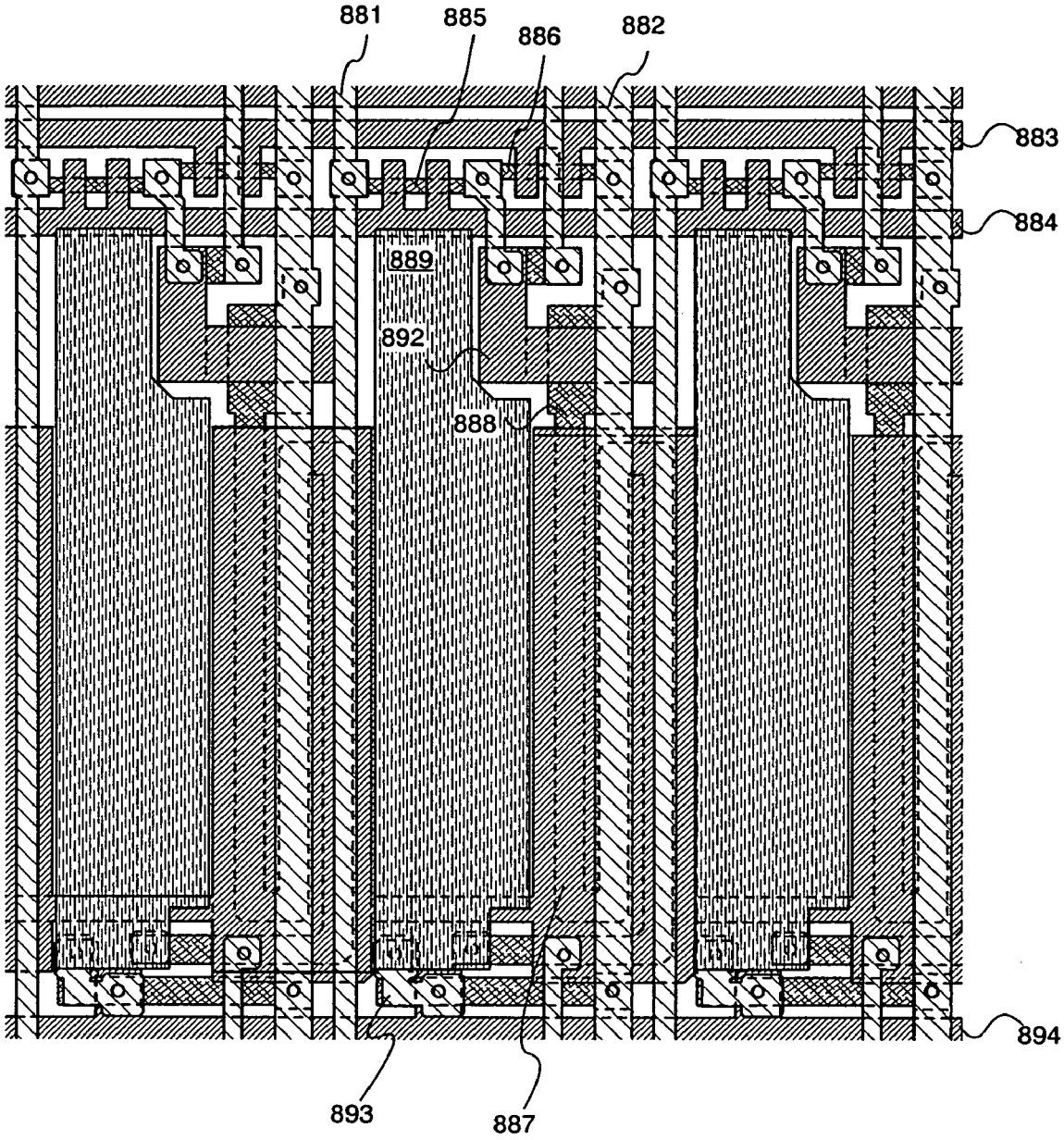
FIG. 10 is a top plan view of the pixel of the display device of the invention.

In FIG. 10, a signal line 881, a first power supply line 882, a second scan line 883, a first scan line 884, a switching transistor 885, an erasing transistor 886, a driving transistor 887, a current controlling transistor 888, the first electrode 889 of a light emitting element, a capacitor 892, a transistor 893 of which first electrode and the gate electrode are connected (referred to as a diode), and a power supply line 894 for the diode for controlling the diode are provided. In FIG. 10, an n-channel transistor is used as the diode 893, of which gate electrode and the drain electrode are connected by a second conductive film. When a p-channel transistor is used as the diode 893, the gate electrode and the drain electrode thereof may be connected by the second conductive film.

In the top plan view shown in FIG. 10, the diode 893 is provided between the first electrode 889 of the light emitting element and the first power supply line 882. A part of the power supply line 894 for the diode corresponds to the gate electrode of the diode 893. When a reverse voltage is applied, a signal to turn ON the diode 893 is inputted to the power supply line 894 for the diode. The top plan view of FIG. 10 corresponds to the circuit having a diode in the pixel portion as shown in FIGS. 4B, 4D, and 4F.

The diode 893 is not limited to the structure described in this embodiment mode, but may be formed so as to have a pn-junction.

As described in this embodiment mode, a reverse voltage can be applied to the pixel configuration which can have various top plan views. As a result, the life of a display device is extended.

EMBODIMENT MODE 7

Electronic devices to which the invention can be applied include a digital camera, an audio reproduction device such as a car audio, a notebook personal computer, a game machine, a portable information terminal (a portable phone, a portable game machine and the like), an image reproduction device such as a home game machine provided with a recording medium and the like. Specific examples of these devices are shown in FIGS. 11A to 11H.

Figure 11A:
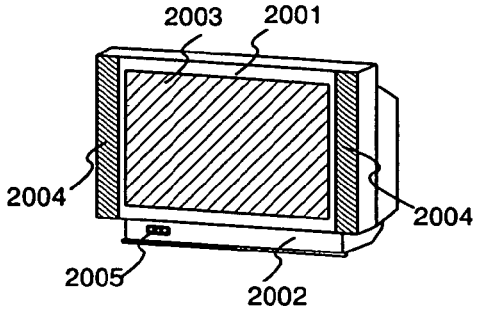
FIGS. 11A to 11H are views describing electronic devices of the invention.

FIG. 11A illustrates a display device including a housing 2001, a support base 2002, a display portion 2003, speaker portions 2004, a video input terminal 2005 and the like.

Figure 11B:
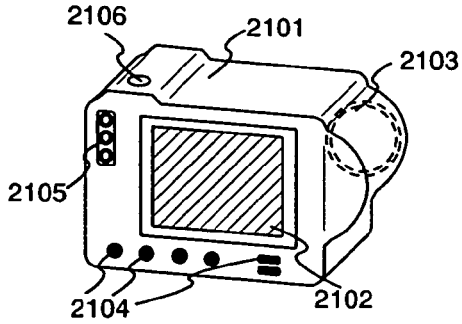

FIG. 11B illustrates a digital still camera including a body 2101, a display portion 2102, an image receiving portion 2103, operating keys 2104, an external connection port 2105, a shutter 2106 and the like.

Figure 11C:
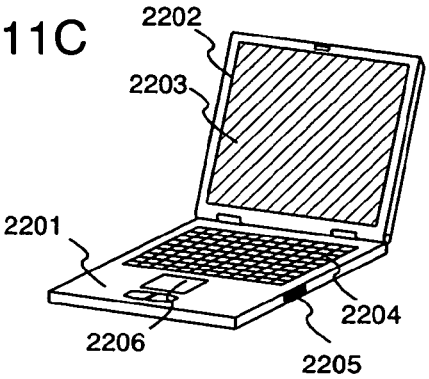

FIG. 11C illustrates a notebook personal computer including a body 2201, a housing 2202, a display portion 2203, a keyboard 2204, an external connection port 2205, a pointing mouse 2206 and the like.

Figure 11D:
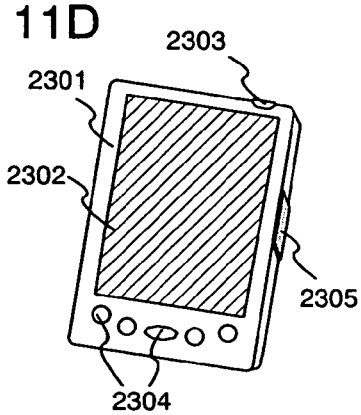

FIG. 11D illustrates a mobile computer including a body 2301, a display portion 2302, a switch 2303, operating keys 2304, an infrared port 2305 and the like.

Figure 11E:
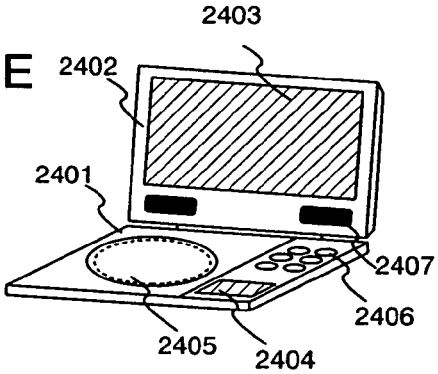

FIG. 11E illustrates a portable image reproduction device provided with a recording medium, including a body 2401, a housing 2402, a display portion A 2403, a display portion B 2404, a recording medium reading portion 2405, an operating key 2406, a speaker portion 2407 and the like. The display portion A 2403 mainly displays image data while the display portion B 2404 mainly displays text data.

Figure 11F:
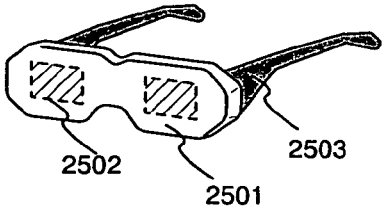

FIG. 11F illustrates a goggle-type display including a body 2501, a display portion 2502, and an arm portion 2503.

Figure 11G:
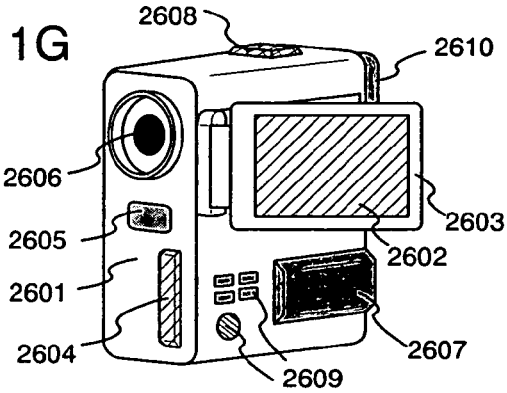

FIG. 11G illustrates a video camera including a body 2601, a display portion 2602, a housing 2603, an external connection port 2604, a remote control receiving portion 2605, an image receiving portion 2606, a battery 2607, an audio input portion 2608, operating keys 2609, eye piece 2610 and the like.

Figure 11H:
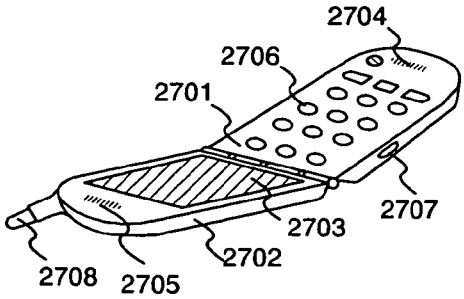

FIG. 11H illustrates a portable phone as a portable terminal, including a body 2701, a housing 2702, a display portion 2703, an audio input portion 2704, an audio output portion 2705, an operating key 2706, an external connection port 2707, an antenna 2708 and the like.

In the case where each of the aforementioned electronic devices are provided with a panel having a light emitting element which degrades over time, the degradation can be suppressed because a reverse voltage can be applied without short-circuiting the anode line and the signal line. Therefore, after the device is delivered to an end user as well, the life of the device itself can be extended by applying a reverse voltage when the device is not in use.

This embodiment mode can be freely combined with the aforementioned embodiment modes.

EMBODIMENT MODE 8

In this embodiment mode, the reverse voltage applying circuit is connected to the signal line side.

Figure 13A:
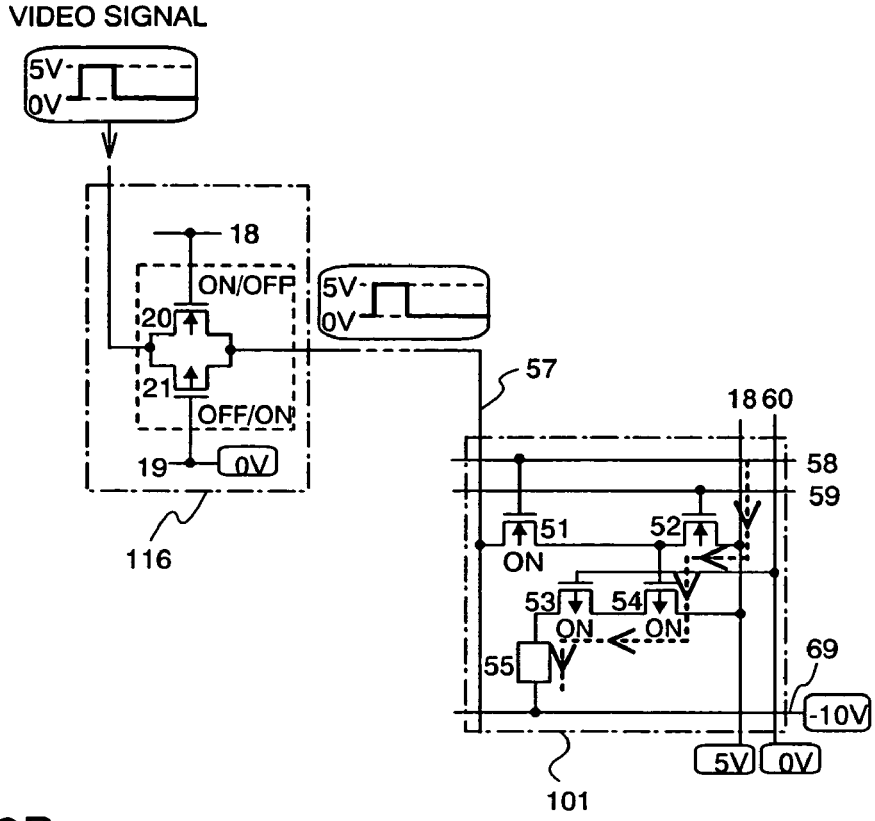
FIGS. 13A and 13B are diagrams describing the display device of the invention and the driving method thereof.

FIG. 13A shows a state in which a forward voltage is applied and the light emitting element emits light. The reverse voltage applying circuit 116 shown in FIG. 13A includes the analog switch 28 having the n-channel transistor 20 and the p-channel transistor 21. The gate electrode of the n-channel transistor 20 is connected to the anode line 18 of which potential is maintained at 5 V in this embodiment mode. The gate electrode of the p-channel transistor 21 is connected to the power supply line of which potential is maintained constant or to the cathode line. In this embodiment mode, the gate electrode of the p-channel transistor 21 is connected to the first power supply line 19 of which potential is fixed at 0 V. The output wiring (output terminal) of the analog switch 28 is connected to the signal line 57.

In this manner, when connecting the reverse voltage applying circuit 116 to the signal line side, the reverse voltage applying transistor 17 is not required any more.

The other circuit configuration and the transistor in the pixel are the same as those in FIG. 1A, therefore, the description is omitted here. Note that a voltage Vgs between the gate and source of the driving transistor does not change over time due to a parasitic capacitance and a wiring capacitance by fixing the potential of the gate electrode of the driving transistor. Therefore, it is preferable that the potential of the second power supply line 60 is fixed at least when a forward voltage is applied as described in Embodiment Mode 1.

In the aforementioned circuit configuration, a video signal is outputted from the second latch circuit 113 in the signal driver circuit and inputted to the analog switch 28, for example. In this embodiment mode, a video signal has a pulsed signal of Low (for example 0 V) and High (for example 5 V). It should be noted that a video signal may be inputted to the analog switch 28 from the shift register or the first latch circuit, or via the buffer circuit and the like additionally.

At this time, either of the n-channel transistor 20 or the p-channel transistor 21 in the analog switch 28 is turned ON. Specifically, the p-channel transistor 21 is turned ON when a Low video signal is inputted while the n-channel transistor 20 is turned ON when a High video signal is inputted. When the scan line 58 is selected and the switching transistor 51 is turned ON, a video signal is inputted to the pixel 101 via the signal line 57.

Then, the driving transistor 53, the current controlling transistor 54 are turned ON and the light emitting element 55 emits light according to the inputted video signal.

At this time, an erasing period for selecting the reset line 59 is provided as required by operating the erasing transistor 52. The erasing transistor 52 is an n-channel transistor in this embodiment mode, however, it may be a p-channel transistor as well. For the erasing transistor and the operation thereof, refer to Japanese Patent Application Laid-open No. 2001-343933, with which the invention can be used in combination.

The anode line 18 and the second power supply line 60 may be connected to the controlling circuit 118 as described in Embodiment Mode 1.

In the aforementioned state, the potential of the cathode line 69 is −10 V and the potential of the anode line 18 is 5 V. Therefore, a forward voltage is applied to the light emitting element.

Figure 13B:
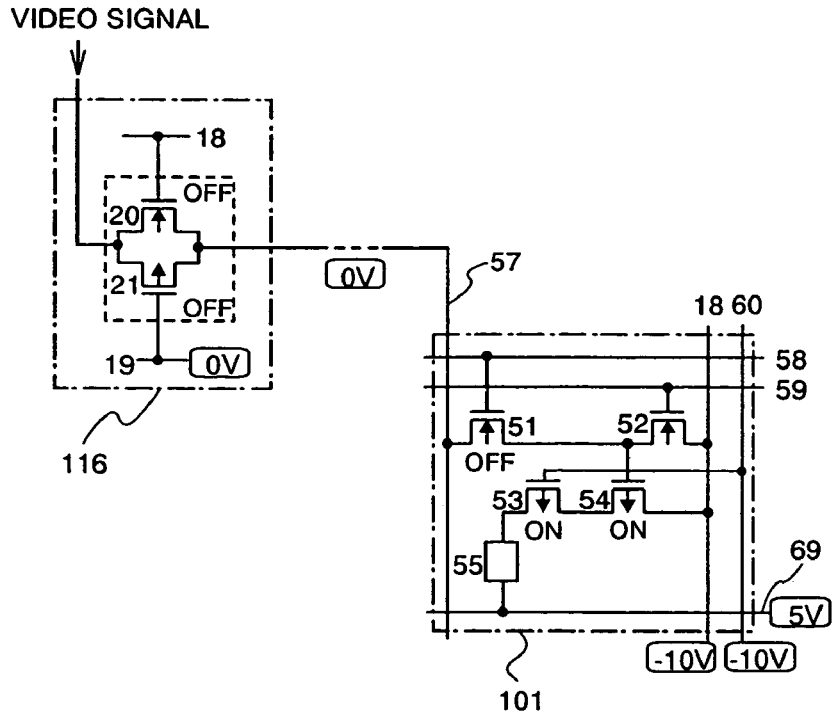

FIG. 13B shows a state in which a reverse voltage is applied. When a reverse voltage is applied, a Low video signal is inputted (for example 0 V). Then, both transistors in the analog switch 28 are turned OFF and the video signal is not inputted to the pixel. Therefore, the switching transistor 51 is turned OFF to which a video signal is not inputted even when the scan line 58 is selected.

When a High video signal (for example 5 V) is inputted immediately before applying a reverse voltage, the analog switch 28 may be turned ON. Therefore, the potential of the signal line 57 is set Low (for example 0 V) immediately before applying a reverse voltage. Specifically, a Low (for example 0 V) video signal is inputted to the signal line 57 immediately before starting the reverse voltage applying period. Thereafter, a reverse voltage is applied to the anode line and the cathode line. For example, the potential of the anode line is −10 V and the potential of the cathode line 69 is 5 V.

At this time, a reverse voltage is efficiently applied by turning ON the driving transistor 53 and the current controlling transistor 54. The driving transistor 53 which is designed so that L/W thereof becomes large for operating in a saturation region might have a high resistance.

Therefore, it is preferable that the first n-channel transistor 61 be turned ON and the second n-channel transistor 62 be turned OFF by using the controlling circuit 118 similar to the one described in Embodiment Mode 1, and the potential of the second power supply line 60 connected to the gate electrode of the driving transistor 53 be −10 V.

As a result, the gate voltage to be applied to the gate electrode of the driving transistor 53 can be high, which can reduce the effect of the resistance of the driving transistor 53 when a reverse voltage is applied. Note that the driving transistor 53 may operate in a linear region as well.

Further, a diode may be provided between the first electrode (an anode in this embodiment mode) of the light emitting element and the anode line 18 in order to offset the resistance of the driving transistor 53 and the current controlling transistor 54.

By turning OFF the analog switch 28, a reverse voltage can be applied without short-circuiting the anode line 18 and the signal line 57.

Subsequently described is the case of applying a forward voltage after a reverse voltage, that is the case of returning each potential. When applying a forward voltage after a reverse voltage, the light emitting element 55 might emit light regardless of the video signal because the potential of the gate electrode of the driving transistor 53 is maintained at −10 V.

Figure 14A:
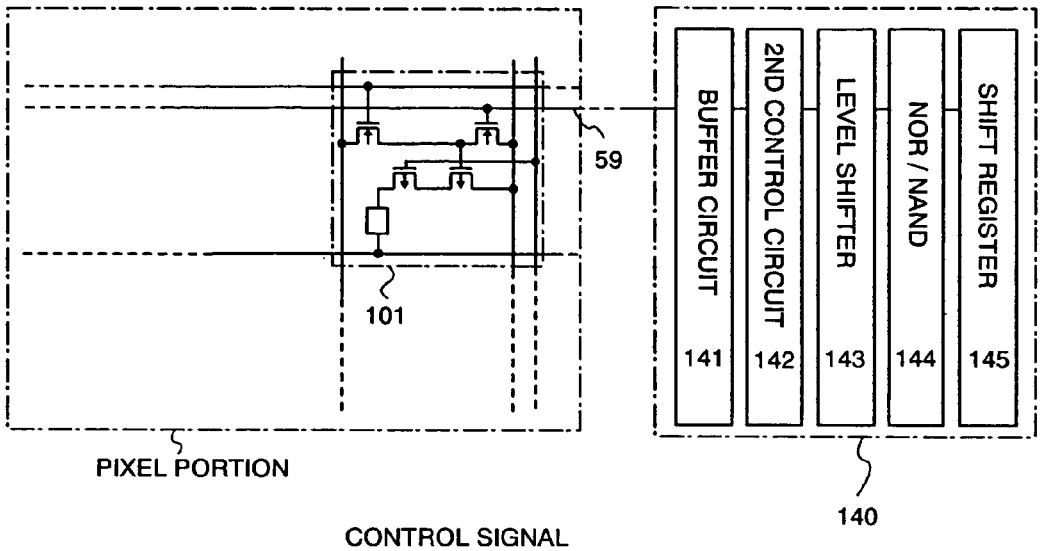
FIGS. 14A to 14C are diagrams describing the display device of the invention and the driving method thereof.

Then, as shown in FIG. 14A, in a scan driver circuit 140 having a buffer circuit 141, a level shifter 143, a NOR/NAND circuit 144, and a shift register 145, a second controlling circuit 142 is provided between the buffer circuit 141 and the level shifter 143. Note that the buffer circuit 141 may be disposed appropriately and the second controlling circuit 142 may be at least connected to each reset line. That is, the second controlling circuit 142 may be provided between a pixel portion and the level shifter 143.

The second controlling circuit is required to be inputted a signal for selecting a scan line when a forward voltage is applied, which is supplied from the scan driver circuit and be capable of controlling the driving transistor 53 and the current controlling transistor 54 to be OFF when a forward voltage is applied after a reverse voltage.

Figure 14B:
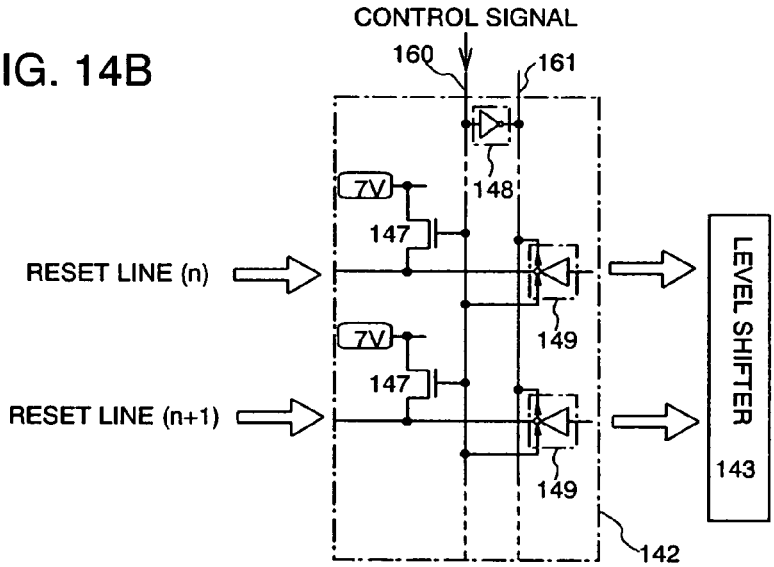

FIG. 14B shows a specific configuration of the second controlling circuit 142. The second controlling circuit 142 has an inverter circuit 148, a p-channel transistor provided for each reset line, and a clocked inverter 149. The first electrode of the transistor 147 is connected to the reset line 59, the gate electrode thereof is connected to a third power supply line 160, and the potential of the second electrode thereof is maintained at 7 V. The inverter circuit 148 is connected to the third power supply line 160 and a fourth power supply line 161. The first terminal of the clocked inverter 149 is connected to the third power supply line 160, the second terminal thereof is connected to the fourth power supply line 161. The input wiring thereof is connected to the reset line 59, and the output wiring thereof is connected to the level shifter 143.

In the second controlling circuit 142, the potential of the reset line 59 can be controlled by inputting a control signal (REV) to the third power supply line 160. Specifically, when a Low control signal is inputted to the third power supply line 160, the transistor 147 is turned ON and the potential of the reset line 59 becomes 7 V. Then, the potential of the anode line is set at 5 V for applying a forward voltage. Then, the erasing transistor 52 is turned ON and the potential of the gate electrode of the current controlling transistor 54 becomes 5 V. At this time, the current controlling transistor 54 is turned OFF. Thereafter, the potential of the cathode line is set at −10 V and a forward voltage is applied.

In this manner, by turning OFF the current controlling transistor 54 by using the second controlling circuit 142, the light emitting element 55 can emit light according to the video signals. Note that the current controlling transistor 54 is turned OFF in this embodiment mode, however, the driving transistor 53 may be turned OFF.

The second controlling circuit 142 is connected to all the reset lines 59 to which a control signal is inputted simultaneously. Thereby, the current controlling transistor 54 can be turned OFF.

The aforementioned operation may be performed for each reset line. In this case, a control signal may be inputted sequentially by selecting the reset lines sequentially in the reverse voltage applying period Tr.

According to the aforementioned operation, it can be prevented that the light emitting element 55 emits light regardless of the video signals in the case of returning to a forward voltage from a reverse voltage. That is to say, the light emitting element emits light according to the video signals.

Figure 14C:
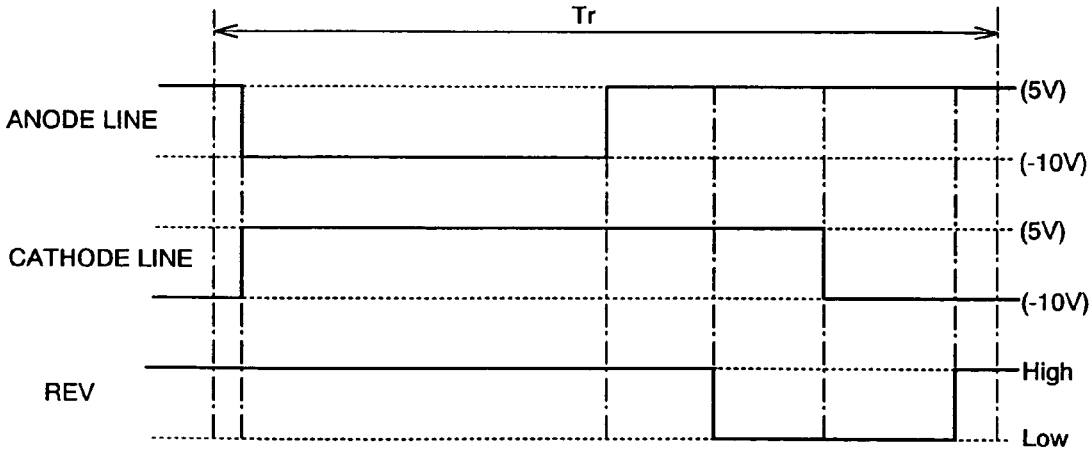

FIG. 14C is a specific timing chart of a voltage applied to the anode line 18 and the cathode line 69 and a control signal (REV) inputted to the third power supply line 160 in the reverse voltage applying period Tr.

First, a reverse voltage is applied to the anode line 18 and the cathode line 69. Specifically, the potential of the anode line 18 is set at −10 V while the potential of the cathode line 69 is set at 5 V. At this time, REV is a High signal. After a predetermined time passes, the potential of the anode line 18 is returned to 5 V and the potential of REV is changed to Low, then the erasing transistor 52 is turned ON. The potential of the reset line 59 becomes 7 V and the current controlling transistor 54 is turned OFF. At this time, the light emitting element 55 does not emit light because the current controlling transistor 54 is OFF.

It should be noted that the potential of REV may be changed to Low prior to the timing the potential of the anode line is set at 5 V, and vice versa. However, it is preferable to change the potential of REV to Low after setting the potential of the anode line 5 V so that unnecessarily high voltage is not applied to the erasing transistor 52.

FIGS. 14A to 14C show the case where the control signal is Low, however, a High control signal may be inputted to the fourth power supply line 161 by connecting the input terminal and the output terminal of the inverter circuit 148 oppositely.

Figure 15A:
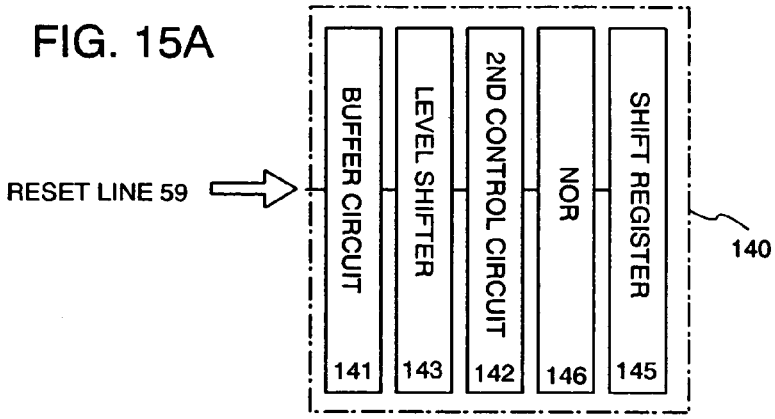
FIGS. 15A to 15C are diagrams describing the display device of the invention and the driving method thereof.

In FIG. 15A, a second controlling circuit which is different from the one shown in FIGS. 14A and 14B is provided between the NOR circuit 146 and the level shifter 143.

Figure 15B:
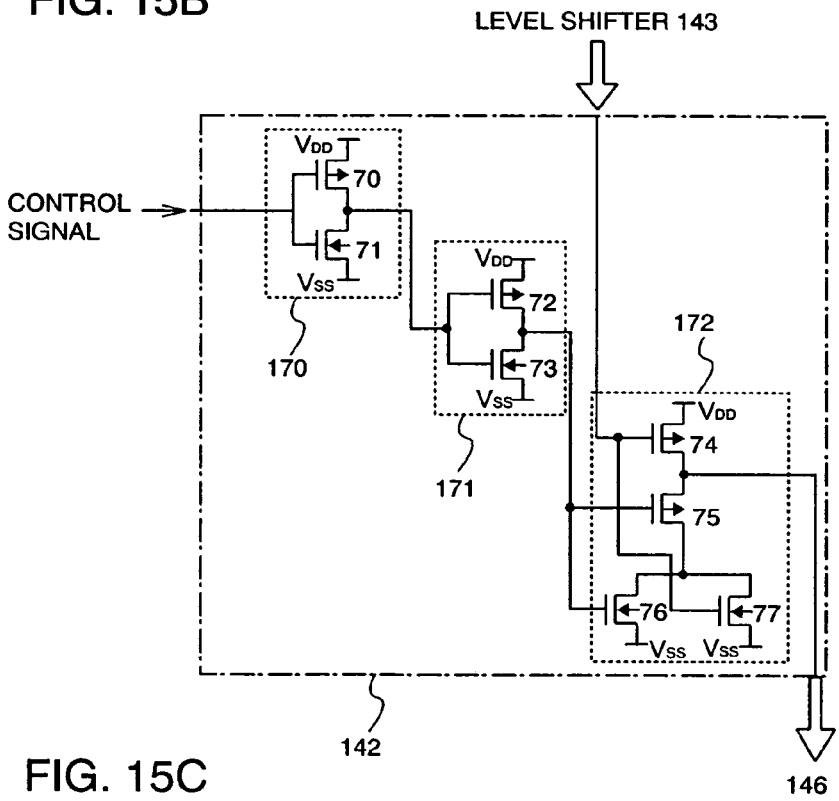

FIG. 15B shows a specific configuration of the second controlling circuit 142. A first inverter circuit 170 to which a clock signal is inputted has a p-channel transistor 70 and an n-channel transistor 71. A second inverter circuit 171 connected to the output wiring of the first inverter circuit 170 has a p-channel transistor 72 and an n-channel transistor 73. A NOR circuit 172 connected to the output wirings of the second inverter circuit 171 and of the NOR circuit 146 has p-channel transistors 74 and 75 connected in series and n-channel transistors 76 and 77 connected in parallel.

When a High control signal is inputted from the input wiring of the first inverter circuit 170 in such a second controlling circuit, the p-channel transistor 74 is turned OFF and the n-channel transistor 77 is turned ON and a Low signal is outputted to the buffer circuit 141. At this time, the erasing transistor 52 can be turned ON. By applying a forward voltage so the cathode line 69 have the potential of −10 V, the current controlling transistor 54 can be turned OFF.

By turning OFF the current controlling transistor 54 by using the second controlling circuit 142, the light emitting element 55 can emit light according to the video signal. The current controlling transistor 54 is turned OFF in this embodiment mode, however, the driving transistor 53 may be turned OFF as well.

Figure 15C:
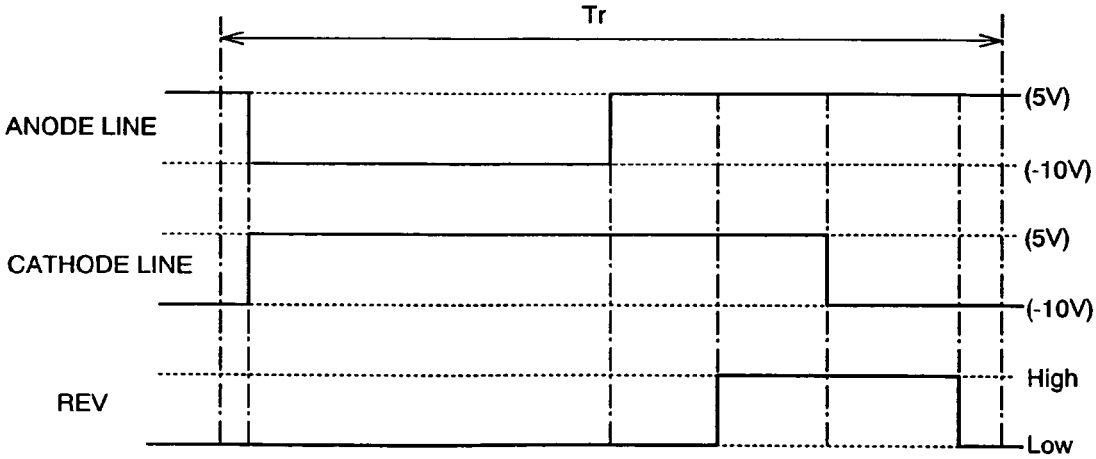

FIG. 15C is a specific timing chart of voltage applied to the anode line 18 and the cathode line 69, and a control signal (REV) in the reverse voltage applying period Tr.

A reverse voltage is applied to the anode line 18 and the cathode line 69. Specifically, the potential of the anode line 18 is set at −10 V and the potential of the cathode line 69 is set at 5 V. At this time, REV is a Low signal. After a predetermined time passes, the potential of the anode line 18 is returned to 5 V and the potential of REV is changed to High, then the erasing transistor 52 is turned ON. The potential of the reset line 59 becomes 7 V. At this time, the light emitting element 55 does not emit light because the current controlling transistor 54 is OFF.

It should be noted that the potential of REV may be changed to High prior to the timing the potential of the anode line is set at 5 V, and vice versa. However, it is preferable to change the potential of REV to High after setting the potential of the anode line at 5 V so that unnecessarily high voltage is not applied to the erasing transistor 52.

According to the aforementioned operation, it can be prevented that the light emitting element 55 emits light regardless of the video signals when returning to a forward voltage from a reverse voltage. That is to say, the light emitting element emits light according to the video signals.

In this embodiment mode, the first electrode of the light emitting element corresponds to an anode, however, it may be a cathode as well.

According to this embodiment mode, a circuit configuration for applying a reverse voltage for enhancing the reliability by controlling the degradation of the light emitting element in a display device having a pixel circuit, and a method thereof can be provided.

Note that the potentials described in this embodiment mode are only an example and the invention is not limited to this.

This application is based on Japanese Patent Application No. 2003-278484 filed in Japan Patent Office on Jul. 23rd, 2003, the contents of which are hereby incorporated by reference.

Although the present invention will be fully described by way of example with reference to the accompanying drawings, it is to be understood that various changes and modifications will be apparent to those skilled in the art. Therefore, unless otherwise such changes and modifications depart from the scope of the present invention, they should be construed as being included therein.

What is claimed is:

1. A display device comprising:

a pixel portion comprising a light emitting element, a fourth transistor, a fifth transistor, and a sixth transistor;

a signal line for in putting a signal to the light emitting element;

a scan line provided across the signal line;

a reverse voltage applying circuit connected to the scan line; and a controlling circuit comprising a seventh transistor and an eighth transistor, wherein the reverse voltage applying circuit comprises:

an analog switch connected to the scan line, the analog switch comprising a first transistor of which a gate electrode is connected to an anode line and a second transistor of which a gate electrode is connected to a first power supply line; and a third transistor of which a gate electrode is connected to a cathode line or the first power supply line, a first electrode thereof is connected to the anode line, and a second electrode thereof is connected to the scan line, wherein a first electrode of the seventh transistor and a gate electrode of the eighth transistor are connected to the anode line, and a second electrode of the seventh transistor and a first electrode of the eighth transistor are connected to a second power supply line, wherein the first transistor and the second transistor have a different polarity with respect to each other, and wherein a gate electrode of the fourth transistor is connected to the scan line, a first electrode of the fourth transistor is connected to a gate electrode of the fifth transistor, a first electrode of the fifth transistor is connected to the anode line, a second electrode of the fifth transistor is connected to a first electrode of the sixth transistor, a second electrode of the sixth transistor is connected to the light emitting element, and a gate electrode of the sixth transistor is connected to the second power supply line.

2. The display device according to claim 1, wherein the display device is incorporated in at least one selected from the group consisting of a digital camera, a personal computer, a mobile computer, a portable image reproduction device, a goggle-type display, a video camera, and a portable phone.

3. The display device according to claim 1, wherein the pixel portion further comprises a ninth transistor, and wherein a first electrode of the ninth transistor is connected to the first electrode of the fourth transistor, and a second electrode of the ninth transistor is connected to the anode line.

4. A display device comprising:

a pixel portion comprising a light emitting element, a fourth transistor, a fifth transistor, and a sixth transistor;

a signal line for inputting a signal to the light emitting element;

a scan line provided across the signal line;

a reverse voltage applying circuit connected to the scan line; and a controlling circuit comprising a seventh transistor and an eighth transistor, wherein the reverse voltage applying circuit comprises:

an analog switch comprising a first transistor of which a gate electrode is connected to an anode line and a second transistor of which a gate electrode is connected to a first power supply line; and a third transistor of which a gate electrode is connected to a cathode line or the first power supply line, a first electrode thereof is connected to the anode line, and a second electrode thereof is connected to an output wiring of the analog switch and the scan line, wherein a first electrode of the seventh transistor and a gate electrode of the eighth transistor are connected to the anode line, and a second electrode of the seventh transistor and a first electrode of the eighth transistor are connected to a second power supply line, wherein the first transistor and the second transistor have a different polarity with respect to each other, and wherein a gate electrode of the fourth transistor is connected to the scan line, a first electrode of the fourth transistor is connected to a gate electrode of the fifth transistor, a first electrode of the fifth transistor is connected to the anode line, a second electrode of the fifth transistor is connected to a first electrode of the sixth transistor, a second electrode of the sixth transistor is connected to the light emitting element, and a gate electrode of the sixth transistor is connected to the second power supply line.

5. The display device according to claim 4, wherein the pixel portion further comprises a ninth transistor, and wherein a first electrode of the ninth transistor is connected to the first electrode of the fourth transistor, and a second electrode of the ninth transistor is connected to the anode line.

6. The display device according to claim 4, wherein the display device is incorporated in at least one selected from the group consisting of a digital camera, a personal computer, a mobile computer, a portable image reproduction device, a goggle-type display, a video camera, and a portable phone.

7. A display device comprising:

a pixel portion comprising a fourth transistor, a fifth transistor, and a sixth transistor;

a scan line;

a first circuit comprising a first transistor, a second transistor, and a third transistor; and a second circuit comprising a seventh transistor and an eighth transistor, wherein a gate electrode of the first transistor is connected to a second power supply line, a gate electrode of the second transistor is connected to a first power supply line, a first electrode of the first transistor and a first electrode of the second transistor is connected to the scan line, a gate electrode of the third transistor is connected to the first power supply line or a third power supply line, a first electrode of the third transistor is connected to the second power supply line, and a second electrode of the third transistor is connected to the scan line, wherein a first electrode of the seventh transistor and a gate electrode of the eighth transistor are connected to the second power supply line, and a second electrode of the seventh transistor and a first electrode of the eighth transistor are connected to a fourth line, wherein the first transistor and the second transistor have a different polarity with respect to each other, and wherein a gate electrode of the fourth transistor is connected to the scan line, a first electrode of the fourth transistor is connected to a gate electrode of the fifth transistor, a first electrode of the fifth transistor is connected to the second power supply line, a second electrode of the fifth transistor is connected to a first electrode of the sixth transistor, and a gate electrode of the sixth transistor is connected to the fourth line.

8. The display device according to claim 7, wherein the pixel portion further comprises a light emitting element, and a second electrode of the sixth transistor is connected to the light emitting element.

9. The display device according to claim 7, wherein the pixel portion further comprises a ninth transistor, and wherein a first electrode of the ninth transistor is connected to the first electrode of the fourth transistor, and a second electrode of the ninth transistor is connected to the second power supply line.

10. The display device according to claim 7, wherein the display device is incorporated in at least one selected from the group consisting of a digital camera, a personal computer, a mobile computer, a portable image reproduction device, a goggle-type display, a video camera, and a portable phone.

11. A display device comprising:

a pixel portion comprising a fourth transistor, a fifth transistor, and a sixth transistor;

a scan line;

a first circuit comprising a first transistor, a second transistor, and a third transistor; and a second circuit comprising a seventh transistor and an eighth transistor, wherein a gate electrode of the first transistor is connected to a second power supply line, a gate electrode of the second transistor is connected to a first power supply line, a first electrode of the first transistor and a first electrode of the second transistor is connected to the scan line, a first electrode of the third transistor is connected to the second power supply line, and a second electrode of the third transistor is connected to the scan line, wherein a first electrode of the seventh transistor and a gate electrode of the eighth transistor are connected to the second power supply line, and a second electrode of the seventh transistor and a first electrode of the eighth transistor are connected to a fourth line, wherein the first transistor and the second transistor have a different polarity with respect to each other, and wherein a gate electrode of the fourth transistor is connected to the scan line, a first electrode of the fourth transistor is connected to a gate electrode of the fifth transistor, a first electrode of the fifth transistor is connected to the second power supply line, a second electrode of the fifth transistor is connected to a first electrode of the sixth transistor, and a gate electrode of the sixth transistor is connected to the fourth line.

12. The display device according to claim 11, wherein the pixel portion further comprises a light emitting element, and a second electrode of the sixth transistor is connected to the light emitting element.

13. The display device according to claim 11, wherein the pixel portion further comprises a ninth transistor, and wherein a first electrode of the ninth transistor is connected to the first electrode of the fourth transistor, and a second electrode of the ninth transistor is connected to the second power supply line.

14. The display device according to claim 11, wherein a gate electrode of the third transistor is connected to the first power supply line.

15. The display device according to claim 11, wherein a gate electrode of the third transistor is connected to a third power supply line.

16. The display device according to claim 11, wherein the display device is incorporated in at least one selected from the group consisting of a digital camera, a personal computer, a mobile computer, a portable image reproduction device, a goggle-type display, a video camera, and a portable phone.

* * * * *